US011530708B2

(12) United States Patent
Hayashi et al.

(10) Patent No.: US 11,530,708 B2
(45) Date of Patent: Dec. 20, 2022

(54) COMPRESSOR HOUSING, COMPRESSOR INCLUDING THE COMPRESSOR HOUSING, AND TURBOCHARGER INCLUDING THE COMPRESSOR

(71) Applicant: MITSUBISHI HEAVY INDUSTRIES, LTD., Tokyo (JP)

(72) Inventors: Yoshihiro Hayashi, Tokyo (JP); Ricardo Martinez-Botas, London (GB); Maria Esperanza Barrera-Medrano, London (GB)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/150,141

(22) Filed: Jan. 15, 2021

(65) Prior Publication Data

US 2021/0246908 A1 Aug. 12, 2021

(30) Foreign Application Priority Data

Feb. 6, 2020 (JP) ..... JP2020-018612

(51) Int. Cl.
*F04D 29/68* (2006.01)
*F04D 29/28* (2006.01)
(Continued)

(52) U.S. Cl.
CPC ..... *F04D 29/685* (2013.01); *F04D 29/284* (2013.01); *F04D 29/4213* (2013.01);
(Continued)

(58) Field of Classification Search
CPC ..... F04D 29/4213; F04D 29/685
See application file for complete search history.

(56) References Cited

U.S. PATENT DOCUMENTS 4,990,053 A * 2/1991 Rohne ..... F04D 29/4213 415/58.4
5,466,118 A * 11/1995 Heinrich ..... F04D 29/4213 415/58.2
(Continued)

FOREIGN PATENT DOCUMENTS

CN 105351240 6/2017
DE 102 23 876 12/2003
(Continued)

OTHER PUBLICATIONS

Extended European Search Report dated Jun. 16, 2021 in corresponding European Patent Application No. 21150694.4.

*Primary Examiner* — Justin D Seabe
(74) *Attorney, Agent, or Firm* — Wenderoth, Lind & Ponack, L.L.P.

(57) ABSTRACT

A compressor housing includes: an intake flow path-forming section configured to form an intake flow path; a shroud portion including a shroud surface curved in a protruding manner to face blades of an impeller; and a scroll flow path-forming section configured to form a scroll flow path through which gas is guided outside the compressor housing. A groove portion extending in a circumferential direction is defined in the shroud surface and, in a cross-sectional view taken along an axis of the impeller, the groove portion includes a downstream side wall surface, wherein a distance from the axis of the impeller to the downstream side wall surface increases toward an upstream side from a downstream side end portion of the groove portion, and an upstream side curved surface that is recessed between an upstream end of the downstream side wall surface and an upstream side end portion of the groove portion.

13 Claims, 15 Drawing Sheets

(51) Int. Cl.
*F04D 29/42* (2006.01)
*F04D 29/44* (2006.01)

(52) U.S. Cl.
CPC ..... *F04D 29/441* (2013.01); *F05D 2220/40* (2013.01); *F05D 2250/51* (2013.01); *F05D 2250/52* (2013.01)

(56) References Cited

U.S. PATENT DOCUMENTS

| | | | | |
|---|---|---|---|---|
| 7,775,759 | B2 * | 8/2010 | Sirakov | F04D 29/685 415/206 |
| 8,172,525 | B2 | 5/2012 | Fukami | |
| 8,257,022 | B2 * | 9/2012 | Guemmer | F04D 29/526 415/144 |
| 8,888,440 | B2 * | 11/2014 | Tomita | F04D 27/023 415/58.4 |
| 8,915,699 | B2 * | 12/2014 | Brignole | F04D 29/526 415/914 |
| 10,047,620 | B2 * | 8/2018 | Giacché | F04D 29/685 |
| 10,273,973 | B2 * | 4/2019 | Zheng | F04D 29/685 |
| 2003/0138317 | A1 | 7/2003 | Barnett et al. | |
| 2009/0246007 | A1 | 10/2009 | Johann | |
| 2010/0098532 | A1 * | 4/2010 | Diemer | F04D 29/685 29/889.22 |
| 2012/0315127 | A1 | 12/2012 | Zheng et al. | |
| 2012/0321440 | A1 | 12/2012 | Zheng et al. | |
| 2020/0347850 | A1 * | 11/2020 | Heuer | F04D 27/003 |

FOREIGN PATENT DOCUMENTS

| | | |
|---|---|---|
| JP | 5039673 | 10/2012 |
| JP | 2019-94847 | 6/2019 |
| WO | 2011/099419 | 8/2011 |

* cited by examiner

| | EX1 (Blade Tip) | EX2 (Blade Mach) | EX3 (Splitter Tip) | EX4 (Splitter Mach) |
|---|---|---|---|---|
| θ1[deg] | 19.32 | 20.00 | 40.00 | 25.00 |
| θ2[deg] | 24.00 | 25.00 | 20.86 | 18.17 |
| W[mm] | 6.12 | 6.15 | 6.00 | 6.57 |
| H[mm] | 10.00 | 10.00 | 10.00 | 8.74 |
| Z[mm] | 47.33 | 38.43 | 24.93 | 16.47 |
| θ1[deg] | 19.32 | 20.00 | 40.00 | 25.00 |
| θ2-θ1[deg] | 4.68 | 5.00 | -19.14 | -6.83 |
| W/H | 0.61 | 0.62 | 0.60 | 0.75 |
| H/R | 0.20 | 0.20 | 0.20 | 0.18 |
| Z/L | 1.02 | 0.83 | 0.54 | 0.35 |

FIG. 7

COMPRESSOR HOUSING, COMPRESSOR INCLUDING THE COMPRESSOR HOUSING, AND TURBOCHARGER INCLUDING THE COMPRESSOR

CROSS-REFERENCE TO RELATED APPLICATIONS

This application claims the benefit of priority to Japanese Patent Application Number 2020-018612 filed on Feb. 6, 2020. The entire contents of the above-identified application are hereby incorporated by reference.

TECHNICAL FIELD

The disclosure relates to a compressor housing, a compressor including the compressor housing, and a turbocharger including the compressor.

RELATED ART

Engines used in automobiles and the like may be equipped with a turbocharger to improve engine output. The turbocharger rotates an impeller of a compressor connected to a turbine rotor via a rotation shaft by rotating the turbine rotor using exhaust gas from an engine. The turbocharger compresses gas used for engine combustion by means of the impeller that is rotationally driven, and supplies the resultant gas to the engine.

A centrifugal compressor used in a turbocharger includes an impeller and a compressor housing that houses the impeller. The impeller guides the gas flowing in from the front side in the axial direction to the outer side in the radial direction. Components formed in the compressor housing include: an intake flow path through which gas is guided from the outside of the compressor housing toward the front side in the axial direction of the impeller; an impeller chamber that is in communication with the intake flow path and accommodates the impeller; and a scroll flow path, in communication with the impeller chamber, through which the gas that has passed through the impeller is guided to the outside of the compressor housing.

Such a compressor preferably has a wide range, that is, a high pressure ratio to be achieved over a wide operation range. Unfortunately, an unstable phenomenon known as surging (massive gas vibration in the flow direction of the gas) may occur under a low flow rate condition where the intake flow volume of the compressor is low. In order to avoid surging, the operation range of the compressor is limited under the low flow rate condition. Thus, a method for suppressing surging has been studied for the purpose of achieving a wide range in a low flow rate range.

WO 2011/099419 A discloses a centrifugal compressor 011 including a compressor housing 04 with a recirculation flow path 043 formed therein. The recirculation flow path 043 has a first end portion side connected to an impeller chamber 041 that houses an impeller 03 and a second end portion side connected to an intake flow path 042 positioned further upstream than the impeller chamber 041, as illustrated in FIG. 14. Such a compressor 011 can suppress surging even when the flow rate of the gas flowing from the outside of the compressor housing 04 to the impeller chamber 041 through the intake flow path 042 is low, because the flow volume of the gas sent to the inlet side of the impeller 03 can be increased when a part of the gas inside the impeller chamber 041 returns to the impeller chamber 041 through the recirculation flow path 043 and the intake flow path 042.

A compressor used for a turbocharger has a downstream side, in the flow direction of gas, connected to an engine, and thus is exposed to pressure pulsation due to air intake of the engine. This results in the gas flowing in the compressor housing being in a form of a non-steady flow with pulsation. This flow is known to provide a surging suppressing effect which is not obtained by a constant flow without pulsation.

SUMMARY

Unfortunately, when the compressor includes the compressor housing formed with the recirculation flow path, a sufficient surging suppressing effect with the pulsation cannot be achieved. As illustrated in FIG. 14, the relationship of FR1=FR2+FR3 is satisfied where FR1 represents the flow rate of gas flowing into the impeller 03 in the impeller chamber 041, FR2 represents the flow rate of the intake gas that flows in the intake flow path 042 after flowing in from the outside of the compressor housing 04, and FR3 represents the flow rate of the recirculation flow flowing to the intake flow path 042 from the impeller chamber 041 through the recirculation flow path 043. As illustrated in FIG. 15, the phase of the flow rate FR3 of the recirculation flow driven by the difference in pressure between the inlet and the outlet of the recirculation flow path 043 differs from that of the intake flow rate FR2. The intake flow rate FR2 and the flow rate FR3 of the recirculation flow having phases different from each other are combined, resulting in an amplitude FV1 of the flow rate FR1 of the gas flowing into the impeller 03 being smaller than an amplitude FV2 of the intake flow rate FR2. In other words, the intake flow rate FR2 and the flow rate FR3 of the recirculation flow interfere with each other on the inlet side of the impeller 03 such that their pulsations offset each other. Thus, the surging suppression effect by pulsation is lost.

In view of the above, an object of at least one embodiment of the present disclosure is to provide a compressor housing, a compressor, and a turbocharger with which a wider range over a low flow rate range can be achieved without compromising a surging suppression effect achieved by pulsation of an internal combustion engine provided on the downstream side of the compressor.

A compressor housing according to the present disclosure is a compressor housing configured to rotatably house an impeller including a hub and a plurality of blades provided on an outer surface of the hub, the compressor housing including:

an intake flow path-forming section configured to form an intake flow path through which gas is introduced to the impeller from outside of the compressor housing;

a shroud portion including a shroud surface curved in a protruding manner to face the plurality of blades; and a scroll flow path-forming section configured to form a scroll flow path through which the gas that has passed through the impeller is guided to the outside of the compressor housing, wherein at least one groove portion extending in a circumferential direction is formed in the shroud surface, and in a cross-sectional view taken along an axis of the impeller, the at least one groove portion includes:

a downstream side wall surface, a distance to which from the axis increases toward an upstream side from a downstream side end portion of the at least one groove portion, and an upstream side curved surface that is formed to be curved in a recessed manner between an upstream end of the downstream side wall surface and an upstream side end portion of the at least one groove portion, and is configured to have a most upstream position positioned further upstream than the upstream side end portion.

A compressor according to the present disclosure includes:

an impeller including at least a hub and a plurality of blades provided on an outer surface of the hub; and the compressor housing.

A turbocharger according to the present disclosure includes:

the compressor; and a turbine including a turbine rotor connected to the impeller of the compressor via a rotational shaft.

With at least one embodiment of the present disclosure, a compressor housing, a compressor, and a turbocharger are provided with which a wider range over a low flow rate range can be achieved without compromising a surging suppression effect achieved by pulsation of an internal combustion engine provided on the downstream side of the compressor.

BRIEF DESCRIPTION OF DRAWINGS

The disclosure will be described with reference to the accompanying drawings, wherein like numbers reference like elements.

FIG. 7 is an explanatory diagram illustrating Examples of a compressor housing according to an embodiment of the present disclosure.

DESCRIPTION OF EMBODIMENTS

Embodiments of the present disclosure will be described hereinafter with reference to the appended drawings. It is intended, however, that unless particularly specified, dimensions, materials, shapes, relative positions and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprising", "including", or "having" one component is not intended to be exclusive of other components.

The same configurations may be denoted by the same reference signs, and the description thereof may be omitted.

Turbocharger

Figure 1:
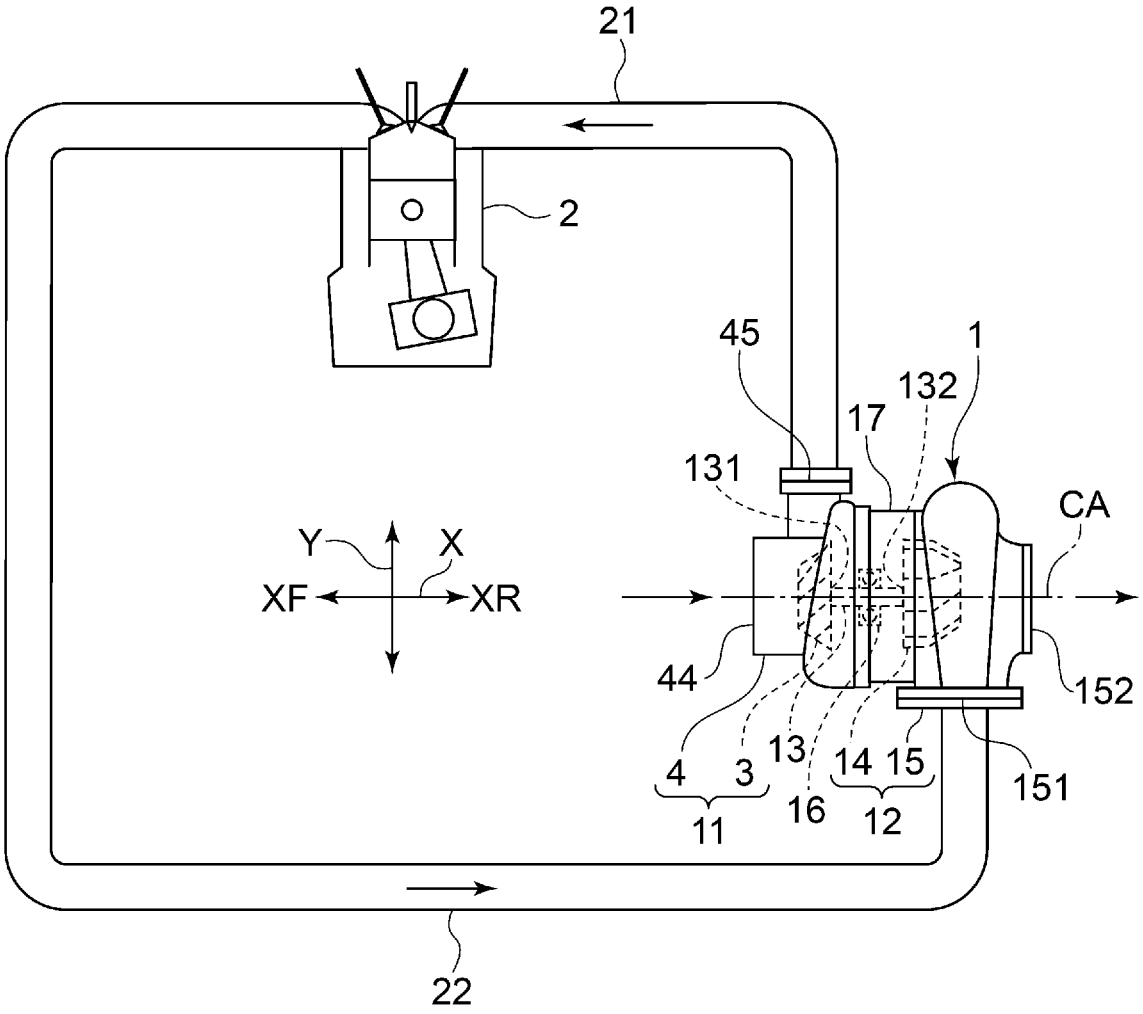
FIG. 1 is an explanatory diagram illustrating a configuration of a turbocharger according to an embodiment of the present disclosure.

FIG. 1 is an explanatory diagram illustrating a configuration of a turbocharger according to an embodiment of the present disclosure.

A turbocharger 1 according to embodiments of the present disclosure includes a compressor 11, a turbine 12, and a rotation shaft 13, as illustrated in FIG. 1. The compressor 11 includes an impeller 3 and a compressor housing 4 configured to rotatably house the impeller 3. The turbine 12 includes a turbine rotor 14 connected to the impeller 3 via the rotation shaft 13, and a turbine housing 15 configured to rotatably house the turbine rotor 14. The turbocharger 1 is a turbocharger for an automobile. Note that some embodiments of the present disclosure may be applied to a turbocharger other than a turbocharger for an automobile (for example, a turbocharger for power generation or marine vessels).

In the illustrated embodiment, the turbocharger 1 further includes a bearing 16 that rotatably supports the rotation shaft 13, and a bearing housing 17 configured to accommodate the bearing 16, as illustrated in FIG. 1. The bearing housing 17 is disposed between the compressor housing 4 and the turbine housing 15, and is mechanically connected to the compressor housing 4 and the turbine housing 15 by a fastening member such as a fastening bolt or a V clamp.

In the following description, as illustrated in FIG. 1 for example, an extending direction of an axis CA of the impeller 3 housed in the compressor housing 4 is defined as an axial direction X, and a direction orthogonal to the axis CA is defined as a radial direction Y. In the axial direction X, a side on which a gas introduction port 44 is positioned relative to the impeller 3 (left side in the figure) is defined as a front side XF, and a side on which the impeller 3 is positioned relative to the gas introduction port 44 (right side in the figure) is defined as a rear side XR.

As illustrated in FIG. 1, the gas introduction port 44 through which gas from the outside of the compressor housing 4 is introduced, and a gas discharge port 45 through which gas that has passed through the impeller 3 is discharged to the outside of the compressor housing 4 to be sent to an internal combustion engine 2 (for example, an engine) are formed in the compressor housing 4. As illustrated in FIG. 1, an exhaust gas introduction port 151 through which exhaust gas is introduced into the turbine housing 15, and an exhaust gas discharge port 152 through which exhaust gas that has rotated the turbine rotor 14 is discharged to the outside of the turbine housing 15 along the axial direction X are formed in the turbine housing 15.

The rotation shaft 13 has a longitudinal direction extending along the axial direction X, as illustrated in FIG. 1. The impeller 3 is mechanically connected to a first end portion 131 (end portion on the front side XF) in the longitudinal direction of the rotation shaft 13, and the turbine rotor 14 is mechanically connected to a second end portion 132 (end portion on the rear side XR) in the longitudinal direction of the rotation shaft 13. The impeller 3 is provided to be coaxial with the turbine rotor 14. The phrase "along a certain direction" not only includes the certain direction but also includes a direction that is inclined with respect to the certain direction (e.g., within ±45° relative to the certain direction).

As illustrated in FIG. 1, the impeller 3 is provided on a supply line 21 through which gas (for example, combustion gas such as air) is supplied to the internal combustion engine 2. The turbine rotor 14 is provided on an exhaust line 22 through which the exhaust gas discharged from the internal combustion engine 2 is discharged.

The turbocharger 1 rotates the turbine rotor 14 using the exhaust gas introduced from the internal combustion engine 2 into the turbine housing 15 through the exhaust line 22. The impeller 3 is mechanically connected to the turbine rotor 14 via the rotation shaft 13, and thus is rotated by the rotation of the turbine rotor 14. The turbocharger 1 compresses gas introduced into the compressor housing 4 through the supply line 21 by rotating the impeller 3, and transmits the resultant gas to the internal combustion engine 2.

Impeller

Figure 2:
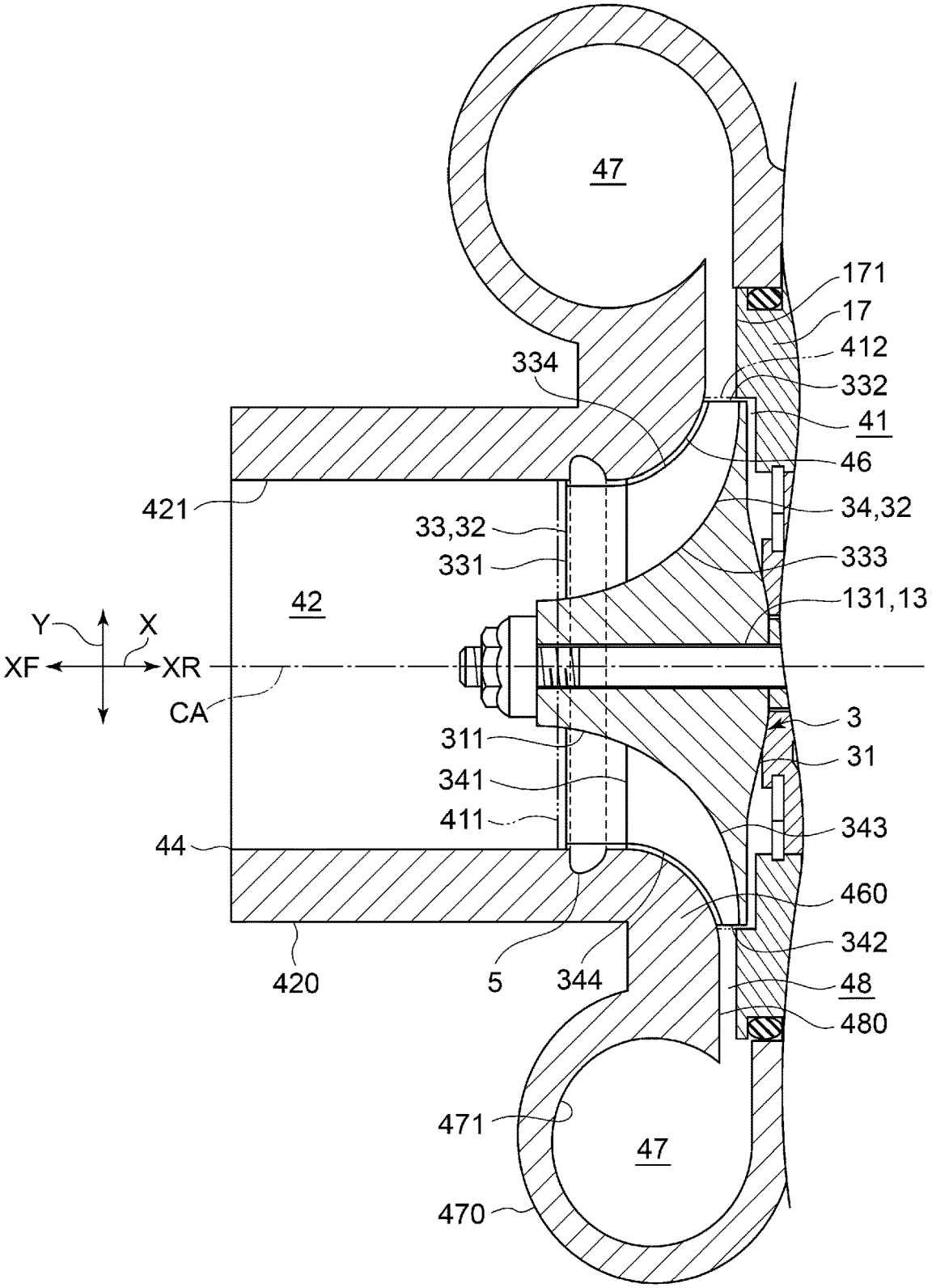
FIG. 2 is a schematic cross-sectional view schematically illustrating a compressor side of the turbocharger including a compressor according to one embodiment of the present disclosure, and is a schematic cross-sectional view including an axis of a compressor housing.

FIG. 2 is a schematic cross-sectional view schematically illustrating a compressor side of the turbocharger including the compressor according to one embodiment of the present disclosure, and is a schematic cross-sectional view including an axis of the compressor housing.

The impeller 3 of the compressor 11 includes a hub 31 and a plurality of blades 32 provided on an outer surface 311 of the hub 31, as illustrated in FIG. 2. The hub 31 is mechanically affixed to the first end portion 131 of the rotatable shaft 13, whereby the hub 31 and the plurality of blades 32 are provided to the rotation shaft 13 to be integrally rotatable about the rotational axis of the rotatable shaft 13. The impeller 3 is configured to guide the gas sent from the front side XF in the axial direction X to the outer side in the radial direction Y.

In the illustrated embodiment, the outer surface 311 of the hub 31 is formed into a recessed curved shape such that a distance from the rotational axis increases toward the rear side XR from the front side XF in the axial direction X, and is formed on the front side XF in the axial direction X.

In the illustrated embodiment, the plurality of blades 32 are disposed at intervals in the circumferential direction about the rotational axis. The plurality of blades 32 include a plurality of long blades (full blades) 33 extending from an inlet part 411 to an outlet part 412 for the gas of the impeller chamber 41 housing the impeller 3, and a plurality of short blades (splitter blades) 34 having a shorter extending length than the long blades 33. The long blades 33 and the short blades 34 are disposed alternately in the circumferential direction. The long blades 33 and the short blades 34 are formed to have a three-dimensionally curved plate shape. Each of the plurality of short blades 34 extends to the outlet part 412 from a portion more on the downstream side than a leading edge 331, which is an edge of the long blade 33 on the side of the inlet part 411, in each flow path for the gas formed between adjacent long blades 33, 33 on the outer surface 311 of the hub 31.

As illustrated in FIG. 2, each of the plurality of long blades 33 has the leading edge 331, which is the edge on the side of the inlet part 411, a trailing edge 332 that is an edge on the side of the outlet part 412, a hub side edge 333 that is an edge on the side connected to the hub 31, and a tip side edge 334 that is an edge opposite to the hub side edge 333. Each of the plurality of short blades 34 has a leading edge 341 that is an edge on the side of the inlet part 411, a trailing edge 342 that is an edge on the side of the outlet part 412, a hub side edge 343 that is an edge on the side connected to the hub 31, and a tip side edge 344 that is an edge opposite to the hub side edge 343. A gap (clearance) is formed between each of the tip side edges 334 and 344 and a shroud surface 46 of the compressor housing 4. Note that in some other embodiments, the impeller 3 may only include the long blades 33.

Compressor Housing

Figure 14:
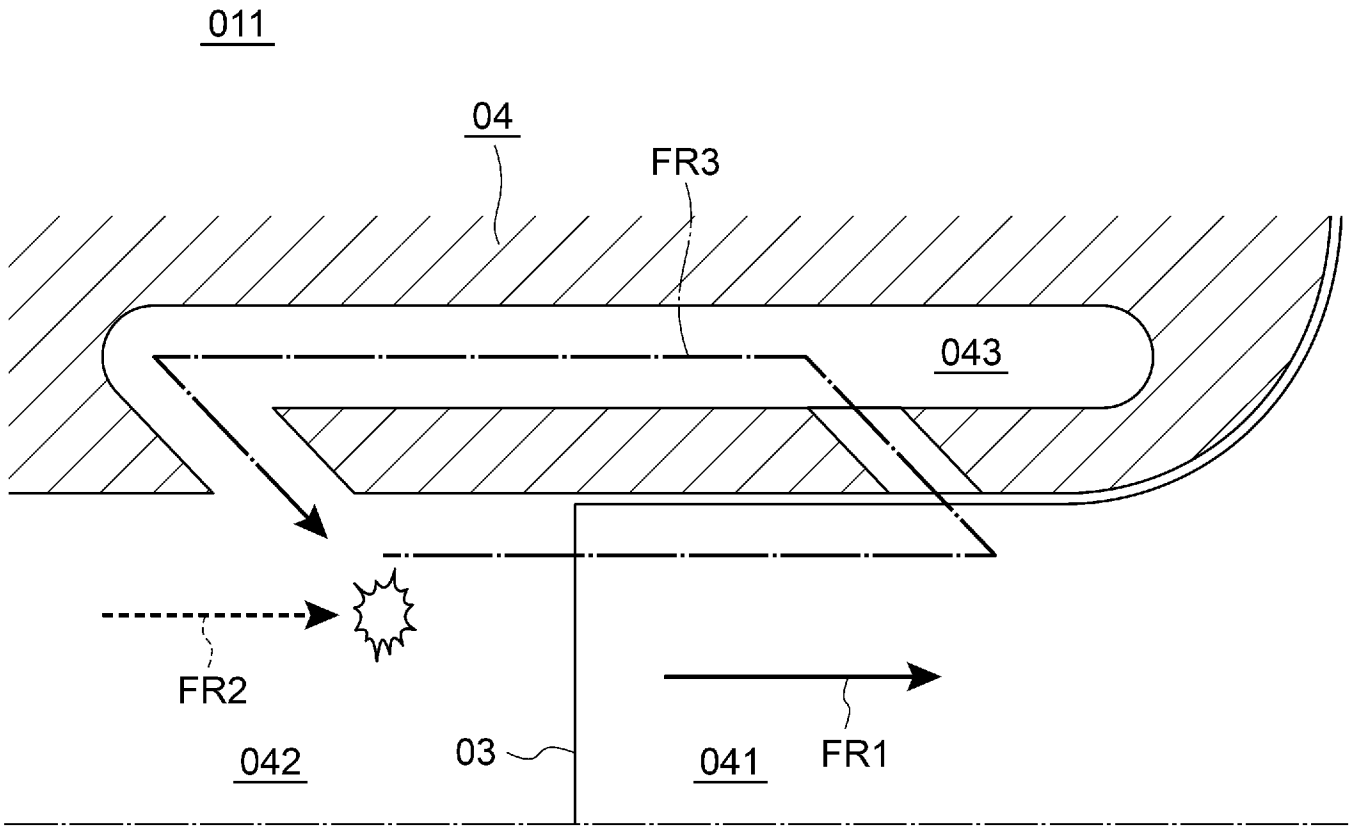
FIG. 14 is an explanatory diagram illustrating a centrifugal compressor including a conventional compressor housing in which a recirculation flow path is formed.
Figure 15:
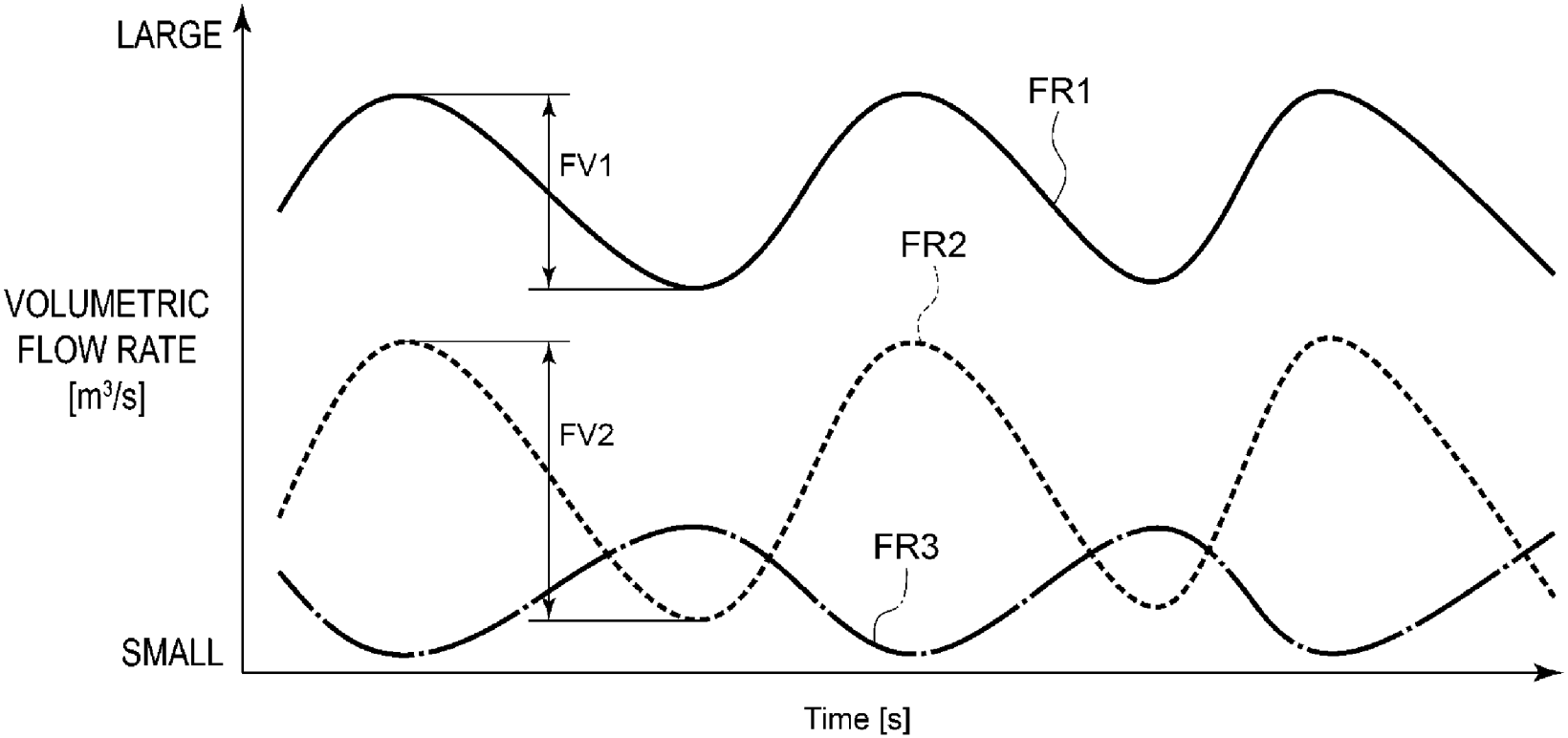
FIG. 15 is an explanatory diagram illustrating attenuation of a pulsation amplitude due to a recirculation flow in the compressor illustrated in FIG. 14.

As illustrated in FIG. 2, the compressor housing 4 includes an intake flow path-forming section 420 that forms an intake flow path 42 through which gas from the outside of the compressor housing 4 is introduced to the impeller 3, a shroud portion 460 having a shroud surface 46 curved in a protruding manner to face the blades 32 (specifically, the tip side edges 334 and 344) of the impeller 3, and a scroll flow path-forming section 470 that forms a scroll flow path 47 through which the gas that has passed through the impeller 3 is guided to the outside of the compressor housing 4. Each of the intake flow path 42 and the scroll flow path 47 is formed inside the compressor housing 4. Note that the recirculation flow path 043 as illustrated in FIG. 14 is not formed in the compressor housing 4.

In the illustrated embodiment, as illustrated in FIG. 2, the compressor housing 4 is configured to form the impeller chamber 41 that rotatably houses the impeller 3 and a diffuser flow path 48 through which the gas from the impeller 3 is guided to the scroll flow path 47, by being combined with another member (such as the bearing housing 17).

Hereinafter, the upstream side in the flow direction of the gas flowing inside the compressor housing 4 may be simply referred to as the "upstream side", and the downstream side in the flow direction of the gas may be simply referred to as the "downstream side".

The intake flow path 42 extends along the axial direction X, and has one end on the front side XF in communication with the gas introduction port 44 positioned further upstream than the intake flow path 42 and an other end on the rear side XR in communication with the inlet part 411 of the impeller chamber 41 positioned further downstream than the intake flow path 42. The diffuser flow path 48 extends along a direction intersecting (orthogonal to, for example) the axial direction X, and has one end on the inner side in the radial direction in communication with the outlet part 412 of the impeller chamber 41 positioned further upstream than the diffuser flow path 48, and has another end on the outer side in the radial direction in communication with the scroll flow path 47 positioned further downstream than the diffuser flow path 48. The scroll flow path 47 has a spiral shape surrounding the periphery of the impeller 3 (the outer side in the radial direction Y) and is in communication with the gas discharge port 45 (see FIG. 1) positioned further downstream than the scroll flow path 47.

The gas is introduced into the compressor housing 4 through the gas introduction port 44 of the compressor housing 4 and then flows in the intake flow path 42 toward the rear side XR along the axial direction X to be sent to the impeller 3. The gas sent to the impeller 3 flows in the diffuser flow path 48 and the scroll flow path 47 in this order, and then is discharged to the outside of the compressor housing 4 through the gas discharge port 45.

The intake flow path-forming section 420 is formed into a tubular shape having the intake flow path 42 therein. The intake flow path-forming section 420 includes an inner wall surface 421 that extends along the axial direction X and defines the intake flow path 42. The gas introduction port 44 is formed at an end portion of the intake flow path-forming section 420 on the front side XF. The scroll flow path-forming section 470 includes a scroll inner wall surface 471 that defines the scroll flow path 47.

The shroud portion 460 is provided between the intake flow path-forming section 420 and the scroll flow path-forming section 470. The shroud surface 46 of the shroud portion 460 defines a portion, on the front side XF, of the impeller chamber 41 described above. The shroud surface 46 faces each of the tip side edges 334 and 344 of the impeller 3. In the illustrated embodiment, a portion of the impeller chamber 41 on the rear side XR is defined by members other than the compressor housing 4, such as an end surface 171 of the bearing housing 17 on the front side XF.

Groove Portion

Figure 3:
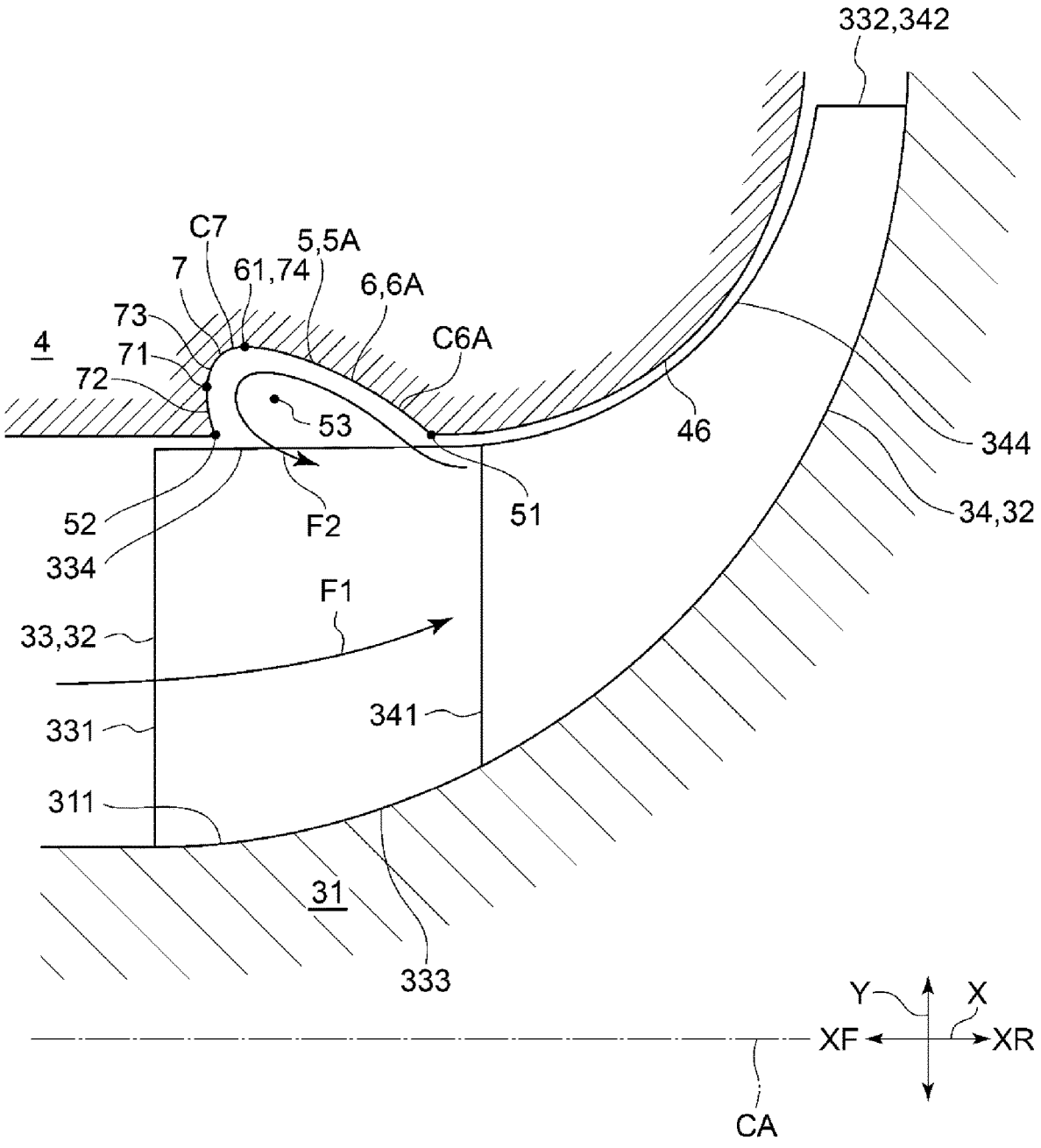
FIG. 3 is an enlarged schematic cross-sectional view of the vicinity of a shroud surface in FIG. 2.

FIG. 3 is an enlarged schematic cross-sectional view of the vicinity of the shroud surface in FIG. 2.

For example, as illustrated in FIG. 3, at least one groove portion 5 extending along the circumferential direction is formed in the shroud surface 46 of the compressor housing 4. In a cross-sectional view taken along the axis CA of the impeller 3 as illustrated in FIG. 3, the at least one groove portion 5 includes a downstream side wall surface 6, the distance to which from the axis CA increases from a downstream side end portion 51 of the groove portion 5 toward the upstream side (left side in the figure), and an upstream side curved surface 7 formed to be curved in a recessed manner between an upstream end 61 of the downstream side wall surface 6 and an upstream side end portion 52 of the groove portion 5. A most upstream position 71 of the upstream side curved surface 7 is configured to be positioned further upstream than the upstream side end portion 52.

In the illustrated embodiment, the downstream side wall surface 6 includes a downstream side curved surface 6A that is curved in a recessed manner toward the outer side in the radial direction. Note that in some other embodiments, the downstream side wall surface 6 may extend linearly, or may be curved in a recessed manner toward the inner side in the radial direction.

In the illustrated embodiment, the upstream side curved surface 7 includes a first upstream side curved surface 72 provided between the most upstream position 71 and the upstream side end portion 52 of the groove portion 5, and a second upstream side curved surface 73 provided between the most upstream position 71 and the upstream end 61 of the downstream side wall surface 6. The first upstream side curved surface 72 is curved in a recessed manner toward the inner side in the radial direction such that the distance between the first upstream side curved surface 72 and the axis CA increases toward the upstream side (front side XF), and has an upstream end at the upstream side end portion 52 of the groove portion 5 and a downstream end at the most upstream position 71. The second upstream side curved surface 73 is curved in a recessed manner toward the outer side in the radial direction such that the distance between the second upstream side curved surface 73 and the axis CA increases toward the downstream side (rear side XR), and has an upstream end at the most upstream position 71 and a downstream end at the upstream end 61 of the downstream side wall surface 6. The second upstream side curved surface 73 is connected to the first upstream side curved surface 72 at the most upstream position 71. Furthermore, the second upstream side curved surface 73 (the upstream side curved surface 7) is connected to the downstream side wall surface 6 at a deepest position 74.

Note that, in some other embodiments, the groove portion 5 may further include a linear or curved surface connecting the upstream end of the first upstream side curved surface 72 and the upstream side end portion 52 of the groove portion 5, and may further include a linear or curved surface connecting the downstream end of the second upstream side curved surface 73 and the upstream end 61 of the downstream side wall surface 6.

Figure 4:
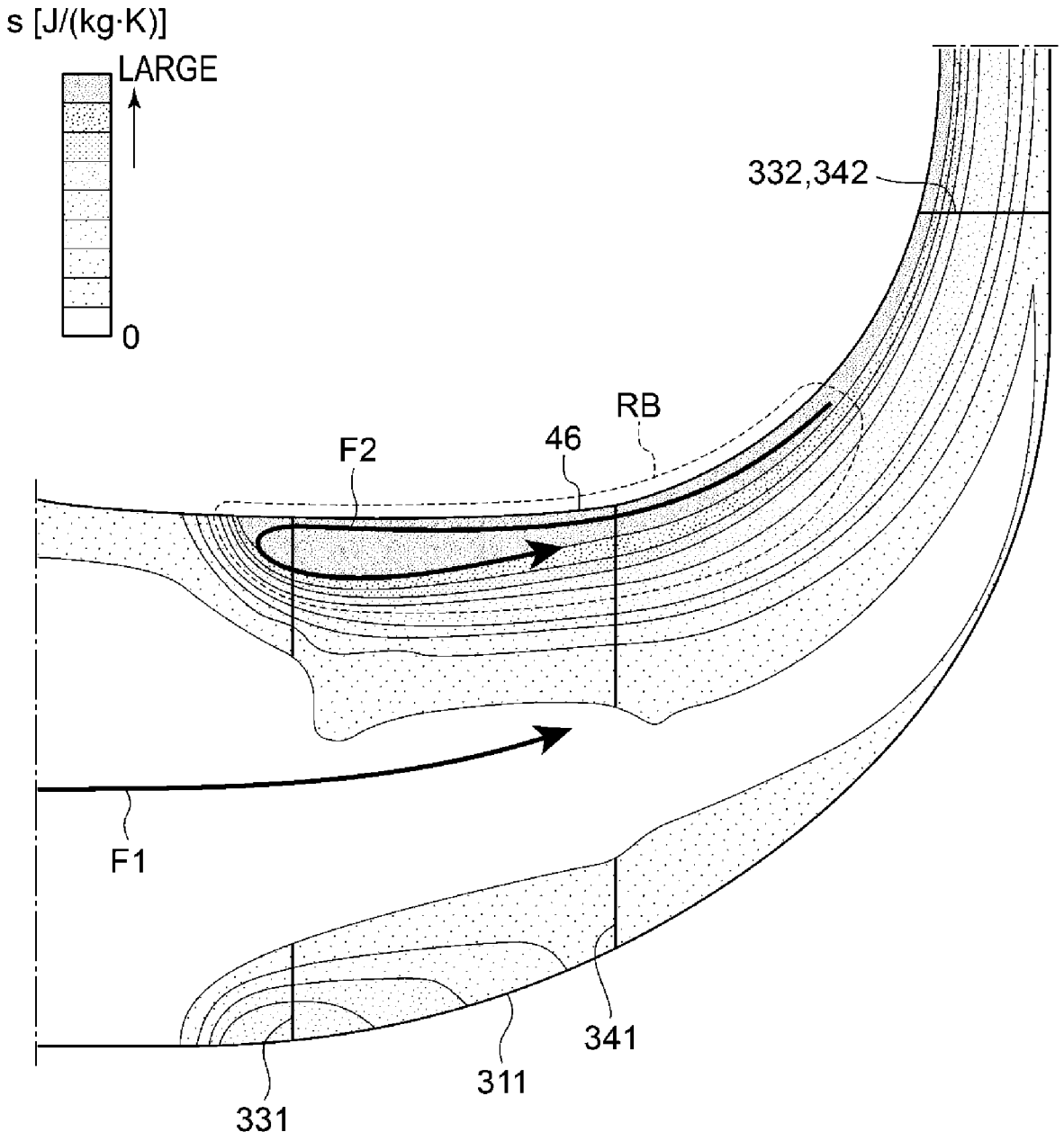
FIG. 4 is an explanatory diagram illustrating how gas flows in the compressor under a low flow rate condition, and illustrates the results of a non-steady flow analysis of a pulsating flow.

FIG. 4 is an explanatory diagram illustrating how gas flows in the compressor under a low flow rate condition, and illustrates the results of a non-steady flow analysis of a pulsating flow. As illustrated in FIG. 4, under the low flow rate condition where the operating point of the compressor is in the vicinity of a surge range, the gas introduced to the impeller 3 is separated from the shroud surface 46 and the blades 32 of the impeller 3 due to an adverse pressure gradient, whereby a backflow range RB is formed near the shroud surface 46 and a backflow F2 (flow toward the front side XF in the axial direction X) flowing along the shroud surface 46 is produced in the backflow range RB. This backflow F2 merges with a main flow F1 of the gas introduced to the impeller 3 in the vicinity of the inlet (leading edge 331) of the impeller 3, and is then introduced again to the impeller 3.

Figure 5:
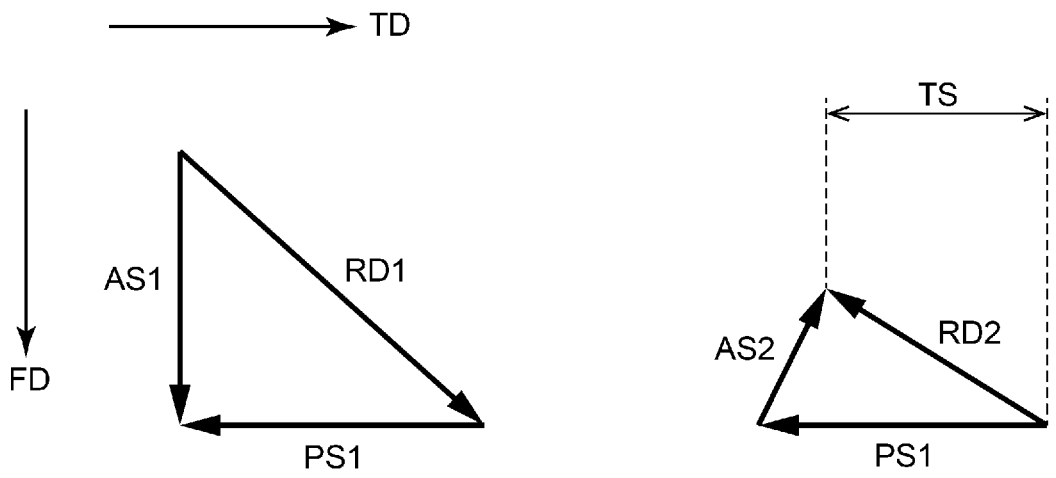
FIG. 5 is an explanatory diagram illustrating how gas flows in the compressor under the low flow rate condition, and illustrates a velocity triangle of the gas introduced to an impeller illustrated in FIG. 4 and a velocity tri angle of backflow flowing in the vicinity of the shroud surface.

FIG. 5 is an explanatory diagram illustrating how gas flows in the compressor under the low flow rate condition, and illustrates the velocity triangle of the gas introduced to the impeller illustrated in FIG. 4 and the velocity triangle of the backflow flowing in the vicinity of the shroud surface. As illustrated in FIG. 5, the flow direction of the main flow F1 of the gas introduced to the impeller 3 is defined as FD, a tangential direction of the impeller 3 is defined as TD, and the main flow F1 forms a velocity triangle comprising an absolute velocity AS1, a relative velocity RD1, and peripheral speed PS1. The backflow F2 flowing along the shroud surface 46 forms a velocity triangle comprising an absolute velocity AS2, a relative velocity RD2, and the peripheral speed PS1. As illustrated in FIG. 5, the backflow F2 involves strong centrifugal action provided by significant tangential speed TS due to the rotation of impeller 3.

As illustrated in FIG. 3, the backflow F2 flowing along the shroud surface 46 is provided with the tangential speed TS due to the rotation of the impeller 3. The centrifugal action provided by the tangential speed TS causes the backflow F2 to flow along the downstream side wall surface 6 and enter the groove portion 5. The upstream side curved surface 7 is curved in a recessed manner. In the upstream side curved surface 7, the most upstream position 71 is positioned further upstream than the upstream side end portion 52. Thus, the backflow F2 that has entered the groove portion 5 can have its flow direction turned around to flow toward the rear side XR from the front side XF in the axial direction with the speed maintained, so as to be sent to the vicinity of the shroud surface 46. With the backflow F2 thus turned around by the groove portion 5 to be sent toward the vicinity of the shroud surface 46, the development of the backflow range RB (see FIG. 4) in the vicinity of the shroud surface 46 can be suppressed. Thus, surging under the low flow rate condition can be suppressed, and a wider range of the compressor 11 in the low flow rate range can be achieved.

For example, as illustrated in FIG. 3, at least one groove portion 5 extending along the circumferential direction is formed in the shroud surface 46 of the compressor housing 4 according to some embodiments. The at least one groove portion 5 described above includes the downstream side wall surface 6 described above and the upstream side curved surface 7 described above. The most upstream position 71 of the upstream side curved surface 7 is configured to be positioned further upstream than the upstream side end portion 52.

According to the configuration described above, the at least one groove portion 5 formed in the shroud surface 46 includes the downstream side wall surface 6, the distance to which from the axis CA increases toward the upstream side from the downstream side end portion 51, and the upstream side curved surface 7 formed between the upstream side end portion 52 and the upstream end 61 of the downstream side wall surface 6. Under the low flow rate condition, the gas introduced to the impeller 3 is separated from the shroud surface 46 and the blades 32 of the impeller 3 due to the adverse pressure gradient, whereby the backflow F2 (flow towards the front side XF in the axial direction X) is produced in the vicinity of the shroud surface 46. This backflow F2 is provided with the tangential speed TS due to the rotation of the impeller 3. The centrifugal action provided by the tangential speed TS causes the backflow F2 to flow along the downstream side wall surface 6 and enter the groove portion 5. The upstream side curved surface 7 is curved in a recessed manner. In the upstream side curved surface 7, the most upstream position 71 is positioned further upstream than the upstream side end portion 52. Thus, the backflow F2 that has entered the groove portion 5 can have its flow direction turned around to flow toward the rear side XR from the front side XF in the axial direction with the speed maintained, so as to be sent to the vicinity of the shroud surface 46. With the backflow F2 thus turned around by the groove portion 5 to be sent toward the vicinity of the shroud surface 46, the development of the backflow range RB in the vicinity of the shroud surface 46 can be suppressed. Thus, surging under the low flow rate condition can be suppressed, and a wider range of the compressor 11 in the low flow rate range can be achieved.

The above-described configuration does not hinder the pulsation of gas introduced to the impeller 3 unlike in the configuration described in WO 2011/099419 A where recirculation flow is introduced to the impeller. Thus, a surging suppression effect can be provided by the pulsation of the internal combustion engine 2 on the downstream side of the compressor 11.

In some embodiments, as illustrated in FIG. 3, the downstream side wall surface 6 described above includes the downstream side curved surface 6A that is curved in a recessed manner toward the outer side in the radial direction and has a curvature smaller than that of the upstream side curved surface 7.

According to the above-described configuration, the downstream side wall surface 6 includes the downstream side curved surface 6A that is curved in a recessed manner toward the outer side in the radial direction. Thus, the distance between the downstream side wall surface 6 and the axis CA between the upstream end 61 of the downstream side curved surface 6A and the downstream side end portion 51 of the groove portion 5 can be increased compared with cases where the downstream side wall surface 6 extends linearly or is curved in a protruding manner. This can prevent the backflow F2 that enters the groove portion 5 along the downstream side curved surface 6A and the turned-around flow (the backflow F2 that has turned around) that is turned around by the upstream side curved surface 7 and flows along the upstream side curved surface 7 to exit from the groove portion 5 from interfering with each other to offset one another. The downstream side curved surface 6A is gently curved with a curvature C6A thereof being smaller than a curvature C7 of the upstream side curved surface 7 to facilitate the entrance of the backflow F2 into the groove portion 5 along the downstream side curved surface 6A, whereby the flow rate of the backflow F2 turned around by the groove portion 5 can be increased. By increasing the flow rate of the backflow F2 that is turned around by the groove portion 5, the development of the backflow range RB in the vicinity of the shroud surface 46 can be effectively suppressed.

In some embodiments, as illustrated in FIG. 3, the at least one groove portion 5 described above includes a ring-shaped groove 5A that extends over the entire circumference in the circumferential direction. In such a case where the ring-shaped groove 5A extends over the entire circumference in the circumferential direction, the backflow F2 can be turned around by the ring-shaped groove 5A anywhere along the entire circumference in the circumferential direction. Thus, the development of the backflow range RB in the vicinity of the shroud surface 46 can be prevented over the entire circumference in the circumferential direction.

Figure 6:
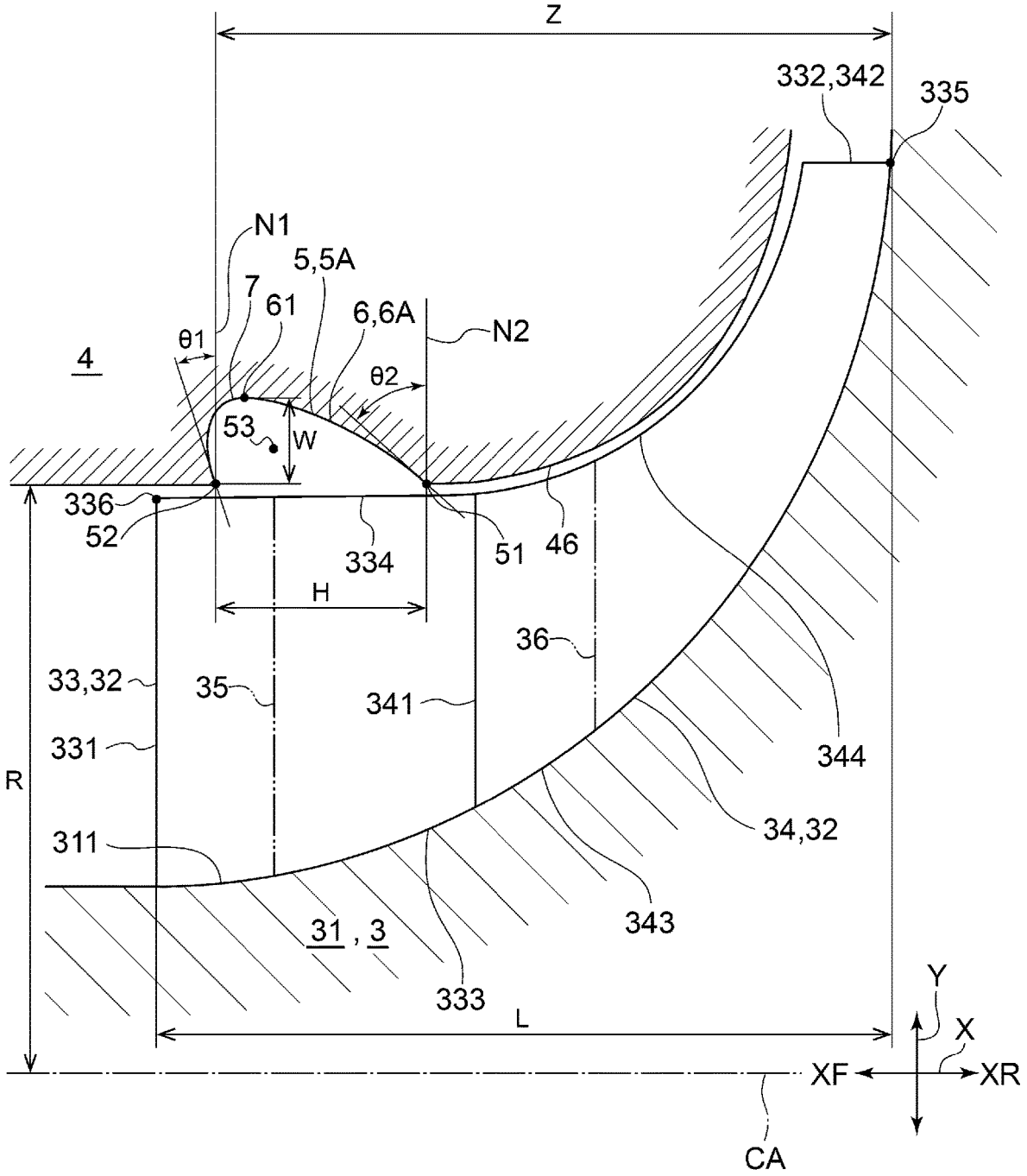
FIG. 6 is an enlarged schematic cross-sectional view of the vicinity of the shroud surface in FIG. 2.

FIG. 6 is an enlarged schematic cross-sectional view of the vicinity of the shroud surface in FIG. 2. FIG. 7 is an explanatory diagram illustrating Examples of a compressor housing according to an embodiment of the present disclosure.

In some embodiments, as illustrated in FIG. 6, the at least one groove portion 5 described above is configured to have a center 53 positioned between the leading edge 331 and the trailing edge 332 of the long blade 33 (the blade 32) in the extending direction (axial direction X) of the axis CA, in a cross-sectional view taken along the axis CA of the impeller 3. Here, the center 53 refers to the center of figure (center of gravity) of the groove portion 5 in the cross-sectional view described above.

In the illustrated embodiment, the at least one groove portion 5 is configured to satisfy $0.2 \leq Z/L \leq 1.2$, where L represents the distance from a hub end 335 of the trailing edge 332 of the long blade 33 (blade 32) to a tip end 336 of the leading edge 331 in the axial direction X, and Z represents a distance from the hub end 335 to the upstream side end portion 52 of the groove portion 5 in the same direction, in the cross-sectional view taken along the axis CA as illustrated in FIG. 6. Preferably, the at least one groove portion 5 is configured to satisfy a condition of $0.3 \leq Z/L \leq 1.1$.

In a first Example (EX1) illustrated in FIG. 7, the groove portion 5 is configured in such a manner that the leading edge 331 of the long blade 33 is positioned between the downstream side end portion 51 and the upstream side end portion 52 in the axial direction X in the cross-sectional view taken along the axis CA. Specifically, in the cross-sectional view described above, the groove portion 5 is configured such that the center 53 is positioned at an axial direction position corresponding to the leading edge 331 of the long blade 33.

Figure 8:
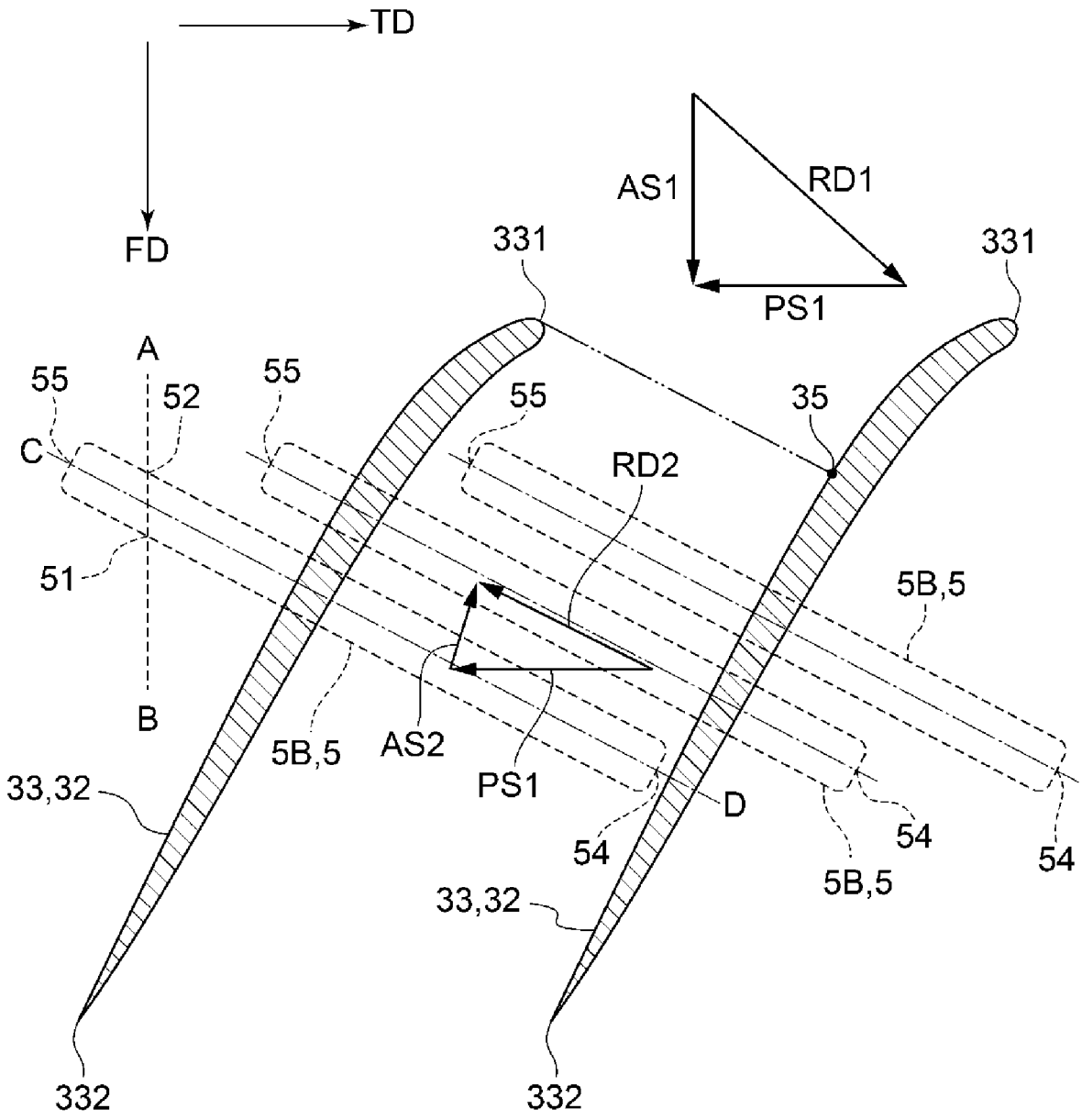
FIG. 8 is an explanatory diagram illustrating the shape of a groove portion according to an embodiment of the present disclosure.

In a second Example (EX2) illustrated in FIG. 7, the groove portion 5 is configured in such a manner that a throat portion 35 of the long blade 33 is positioned between the downstream side end portion 51 and the upstream side end portion 52 in the axial direction X in the cross-sectional view taken along the axis CA. Specifically, in the cross-sectional view described above, the groove portion 5 is configured such that the center 53 is positioned at an axial direction position corresponding to the throat portion 35 of the long blade 33. As illustrated in FIG. 8 described later, the throat portion 35 is a portion where the width of the long blades 33 disposed adjacent to each other along the circumferential direction is minimized. The throat portion 35 is positioned between the leading edge 331 of the long blade 33 and the leading edge 341 of the short blade 34 in the axial direction X.

In a third Example (EX3) illustrated in FIG. 7, the groove portion 5 is configured in such a manner that the leading edge 341 of the short blade 34 is positioned between the downstream side end portion 51 and the upstream side end portion 52 in the axial direction X in the cross-sectional view taken along the axis CA. Specifically, in the cross-sectional view described above, the groove portion 5 is configured such that the center 53 is positioned at an axial direction position corresponding to the leading edge 341 of the short blade 34.

In a fourth Example (EX4) illustrated in FIG. 7, the groove portion 5 is configured in such a manner that a throat portion 36 of the short blade 34 is positioned between the downstream side end portion 51 and the upstream side end portion 52 in the axial direction X in the cross-sectional view taken along the axis CA. Specifically, in the cross-sectional view described above, the groove portion 5 is configured such that the center 53 is positioned at an axial direction position corresponding to the throat portion 36 of the short blade 34. The throat portion 36 is a portion where the width of the long blades 33 and the short blades 34 disposed adjacent to each other along the circumferential direction is minimized. The throat portion 36 is positioned between the leading edge 341 and the trailing edge 342 of the short blade 34 in the extending direction of the axis CA.

Between the leading edge 331 and the trailing edge 332 of the blade 32 in the extending direction of the axis CA, entrance of the backflow F2 flowing along the shroud surface 46 into the groove portion 5 is facilitated by the strong centrifugal action attributable to significant tangential speed TS due to the rotation of the impeller 3. According to the configuration described above, the center 53 of the at least one groove portion 5 is positioned between the leading edge 331 and the trailing edge 332 of the blade 32 in the extending direction of the axis CA. Thus, entrance of the backflow F2 into the groove portion 5 is facilitated by the strong centrifugal action of the backflow F2, whereby the flow rate of the backflow F2 that turns around due to the groove portion 5 can be increased further than in a case where the groove portion 5 is provided at another position in the extending direction of the axis CA. Thus, the development of the backflow range RB in the vicinity of the shroud surface 46 can be suppressed effectively.

For the compressors 11 respectively including the first to fourth Examples, a test for pulsating flow was performed to acquire the pressure flow rate characteristics of the compressors 11. The result of the test indicated that a surging flow rate, which indicates the operating limit on the lower flow rate side, was reduced (up to 6.1% reduction), compared to that in compressors including compressor housings without the groove portion 5 or the recirculation flow path. Thus, a wide range of the compressor 11 under pulsation was confirmed.

In some embodiments, as illustrated in FIG. 6, the at least one groove portion 5 was configured to satisfy a condition of $5° \leq \theta 1 \leq 45°$, where $\theta 1$ represents an inclination angle of the upstream side curved surface 7 relative to a first normal N1 passing through the upstream side end portion 52 of the shroud surface 46 described above. Preferably, the at least one groove portion 5 is configured to satisfy a condition $10° \leq \theta 1 \leq 40°$.

In the illustrated embodiment, the at least one groove portion 5 was configured to satisfy a condition of $15° \leq \theta 2 \leq 30°$, where $\theta 2$ represents an inclination angle of the downstream side wall surface 6 relative to a second normal N2 passing through the downstream side end portion 51 of the shroud surface 46 described above.

In one embodiment, the groove portion 5 is configured such that at least one of the leading edge 331 and the throat portion 35 of the long blade 33 is positioned between the downstream side end portion 51 and the upstream side end portion 52 in the axial direction X. The groove portion 5 is configured to satisfy a condition of $\theta 1 < \theta 2$.

In one embodiment, the groove portion 5 is configured such that at least one of the leading edge 341 and the throat portion 36 of the short blade 34 is positioned between the downstream side end portion 51 and the upstream side end portion 52 in the axial direction X. The groove portion 5 is configured to satisfy a condition of $\theta 1 > \theta 2$.

According to the configuration described above, the inclination angle $\theta 1$ of the upstream side curved surface 7 of the at least one groove portion 5 satisfies the condition of $5° \leq \theta 1 \leq 45°$. Thus, with the backflow F2 exiting the groove portion 5 along the upstream side curved surface 7, the development of the backflow range RB in the vicinity of the shroud surface 46 can be effectively suppressed. If the inclination angle $\theta 1$ is less than 5°, the speed component toward the inner side in the radial direction of the backflow F2 that has exited the groove portion 5 along the upstream side curved surface 7 becomes excessively large and the flow rate of the flow toward the vicinity of the shroud surface 46 becomes small. As a result, the development of the backflow range RB in the vicinity of the shroud surface 46 may fail to be sufficiently suppressed. If the inclination angle θ1 is greater than 45°, the speed component toward the inner side in the radial direction of the backflow F2 that has exited the groove portion 5 along the upstream side curved surface 7 becomes excessively small and the backflow F2 that has exited the groove portion 5 along the upstream side curved surface 7 may interfere with the backflow F2 entering the groove portion 5 along the downstream side wall surface 6. Thus, these flows may offset each other.

In some embodiments, as illustrated in FIG. 6, the at least one groove portion 5 was configured to satisfy a condition of $0.50 \leq W/H \leq 0.85$, where H represents a distance from the upstream side end portion 52 to the downstream side end portion 51 of the at least one groove portion 5 in the extending direction of the axis CA (the axial direction X), and W represents the maximum depth of the at least one groove portion 5. Preferably, the at least one groove portion 5 was configured to satisfy the condition of $0.55 \leq W/H \leq 0.80$. More preferably, the at least one groove portion 5 was configured to satisfy the condition of $0.60 \leq W/H \leq 0.75$.

According to the configuration described above, the at least one groove portion 5 satisfies the condition of $0.50 \leq W/H \leq 0.85$. Thus, with the backflow F2 exiting the groove portion 5 along the upstream side curved surface 7, the development of the backflow range RB in the vicinity of the shroud surface 46 can be effectively suppressed. If the ratio W/H of the maximum depth W to the distance H is less than 0.5, the maximum depth W becomes too small, and the backflow F2 that has exited the groove portion 5 along the upstream side curved surface 7 may interfere with the backflow F2 entering the groove portion 5 along the downstream side wall surface 6. Thus, these flows may offset each other. If the ratio W/H of the maximum depth W to the distance H exceeds 0.85, the maximum depth W becomes too large, and it becomes difficult for the backflow F2 that has entered the groove portion 5 to flow along the downstream side wall surface 6 or the upstream side curved surface 7. Thus, the turned-around flow may fail to be formed.

In some embodiments, as illustrated in FIG. 6, the at least one groove portion 5 was configured to satisfy a condition of $0.10 \leq H/R \leq 0.30$, where H represents a distance from the upstream side end portion 52 to the downstream side end portion 51 of the at least one groove portion 5 in the extending direction of the axis CA (the axial direction X), and R represents the distance from the axis CA to the upstream side end portion 52 in the direction (radial direction Y) orthogonal to the axis CA. Preferably, the at least one groove portion 5 was configured to satisfy the condition of $0.14 \leq H/R \leq 0.26$. More preferably, the at least one groove portion 5 was configured to satisfy the condition of $0.18 \leq H/R \leq 0.22$.

According to the configuration described above, the at least one groove portion 5 satisfies the condition of $0.10 \leq H/R \leq 0.30$, so that an appropriate ratio between the flow rate of the main flow F1 of the gas flowing into the impeller 3 and the flow rate of the backflow F2 flowing into the groove portion 5 can be achieved. By achieving this appropriate ratio, the entrance of the backflow F2 into the groove portion 5 is facilitated, whereby the development of the backflow range RB in the vicinity of the shroud surface 46 can be effectively suppressed.

Figure 9:
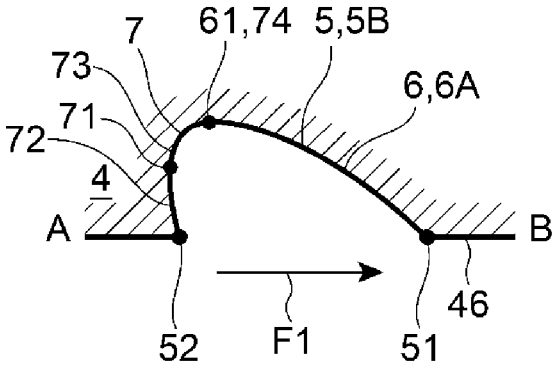
FIG. 9 is a schematic cross-sectional view schematically illustrating an AB cross section of an inclined groove illustrated in FIG. 8.
Figure 10:
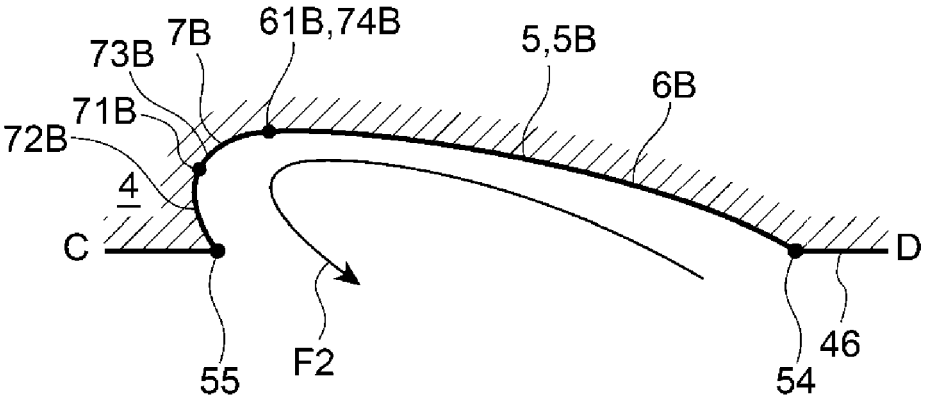
FIG. 10 is a schematic cross-sectional view schematically illustrating a CD cross section of the inclined groove illustrated in FIG. 8.

FIG. 8 is an explanatory diagram illustrating the shape of a groove portion according to an embodiment of the present disclosure. FIG. 9 is a schematic cross-sectional view schematically illustrating an AB cross section of an inclined groove illustrated in FIG. 8. FIG. 10 is a schematic cross-sectional view schematically illustrating a CD cross section of the inclined groove illustrated in FIG. 8.

In some embodiments, as illustrated in FIG. 8, the at least one groove portion 5 described above includes a plurality of inclined grooves 5B that extend partially over the entire circumference in the circumferential direction in a direction inclined with respect to the circumferential direction, and are formed at intervals along the circumferential direction. In the illustrated embodiment, the leading edge 331 of one of two inclined grooves 5B adjacent to each other in the circumferential direction is positioned at a circumferential position corresponding to the trailing edge 332 of the other inclined groove 5B. Note that in some other embodiments, two inclined grooves 5B adjacent to each other in the circumferential direction may overlap each other in the circumferential direction. As illustrated in FIG. 9, each of the plurality of inclined grooves 5B includes the downstream side wall surface 6 (for example, the downstream side curved surface 6A) described above and the upstream side curved surface 7 described above.

According to the configuration described above, the plurality of inclined grooves 5B are formed at intervals along the circumferential direction of the shroud surface 46. Thus, the backflow F2 can be turned around by the plurality of inclined grooves 5B partially over the entire circumference in the circumferential direction. Thus, the development of the backflow range RB in the vicinity of the shroud surface 46 can be prevented partially over the entire circumference in the circumferential direction.

In some embodiments, as illustrated in FIG. 8, each of the plurality of inclined grooves 5B described above is configured to have an end portion 54 on the trailing edge side (downstream side in the flow direction FD of the main flow F1) positioned further downstream (the right side in the figure) than an end portion 55 on the leading edge side (upstream side of the flow direction FD of the main flow F1) in the rotational direction (the tangential direction TD) of the impeller 3. In the illustrated embodiment, as illustrated in FIG. 8, each of the plurality of inclined grooves 5B has a longitudinal direction extending along a direction of a velocity vector of the relative velocity RD2 of the backflow F2.

According to the configuration described above, in each of the plurality of inclined grooves 5B, the end portion 54 on the trailing edge side is positioned further downstream than the end portion 55 on the leading edge side in the rotational direction of the impeller 3. With the inclined grooves 5B thus extending in the direction along the flow direction of the backflow F2, entrance of the backflow F2 into the inclined groove 5B is facilitated, whereby the flow rate of the backflow F2 that is turned around by the inclined grooves 5B can be increased. Thus, the development of the backflow range RB in the vicinity of the shroud surface 46 can be suppressed effectively.

In some embodiments, each of the plurality of inclined grooves 5B includes a trailing edge side wall surface 6B, a distance to which from the axis CA increases toward the end portion 55 on the leading edge side from the end portion 54 on the trailing edge side of the inclined groove 5B, and a leading edge side curved surface 7B formed to be curved in a recessed manner between the leading edge 61B of the trailing edge side wall surface 6B and the end portion 55 on the leading edge side and that is configured to have a most upstream position 71B positioned more on the leading edge side of the inclined groove 5B than the end portion 55 of the leading edge side, in a cross-sectional view taken along the extending direction of the inclined groove 5B as illustrated in FIG. 10.

In the illustrated embodiment, the trailing edge side wall surface 6B includes a trailing edge side curved surface that is curved in a recessed manner toward the outer side in the radial direction (upper side in FIG. 10). Note that in some other embodiments, the trailing edge side wall surface 6B may extend linearly or may be curved in a recessed manner toward the inner side in the radial direction.

In the illustrated embodiment, the leading edge side curved surface 7B includes a first leading edge side curved surface 72B provided between the most upstream position 71B and the end portion 55 of the inclined groove 5B on the leading edge side, and a second leading edge side curved surface 73B provided between the most upstream position 71B and the leading edge 61B of the trailing edge side wall surface 6B. The first leading edge side curved surface 72B is curved in a recessed manner toward the inner side in the radial direction such that the distance between the first leading edge side curved surface 72B and the axis CA increases toward the leading edge side of the inclined groove 5B (downstream side in the flow direction of the backflow F2). Further, the upstream end of the first leading edge side curved surface 72B is the end portion 55 of the inclined groove 5B on the leading edge side and the downstream end of the first leading edge side curved surface 72B is the most upstream position 71B. The second leading edge side curved surface 73B is curved in a recessed manner toward the outer side in the radial direction such that the distance between the second leading edge side curved surface 73B and the axis CA increases toward the trailing edge side of the inclined groove 5B (upstream side in the flow direction of the backflow F2). Further, the upstream end of the second leading edge side curved surface 73B is the most upstream position 71B and the downstream end of the second leading edge side curved surface 73B is the leading edge 61B of the trailing edge side wall surface 6B. The second leading edge side curved surface 73B is connected to the first leading edge side curved surface 72B at the most upstream position 71B. Furthermore, the second leading edge side curved surface 73B (the leading edge side curved surface 7B) is connected to the trailing edge side wall surface 6B at a deepest position 74B.

Note that, in some other embodiments, the inclined groove 5B may further include a linear or curved surface connecting the upstream end of the first leading edge side curved surface 72B and the end portion 55 of the inclined groove 5B on the leading edge side, and may further include a linear or curved surface connecting the downstream end of the second leading edge side curved surface 73B and the leading edge 61B of the trailing edge side wall surface 6B.

According to the configuration described above, each of the plurality of inclined grooves 5B includes the trailing edge side wall surface 6B in a cross-sectional view taken along the extending direction of the inclined groove 5B, that is, the direction along the flow direction of the backflow F2. In this case, the entrance of the backflow F2 into the inclined groove 5B along the trailing edge side wall surface 6B is facilitated, whereby the flow rate of the backflow F2 turned around by the inclined groove 5B can be increased. Each of the plurality of inclined grooves 5B includes the trailing edge side wall surface 6B and the leading edge side curved surface 7B in the cross-sectional view described above. In this case, the backflow F2 that has entered the inclined groove 5B flows along the trailing edge side wall surface 6B and the leading edge side curved surface 7B, and thus can be sent to the vicinity of the shroud surface 46 after having the flow direction turned around while maintaining speed. According to the configuration described above, the development of the backflow range RB in the vicinity of the shroud surface 46 can be suppressed effectively.

Figure 11:
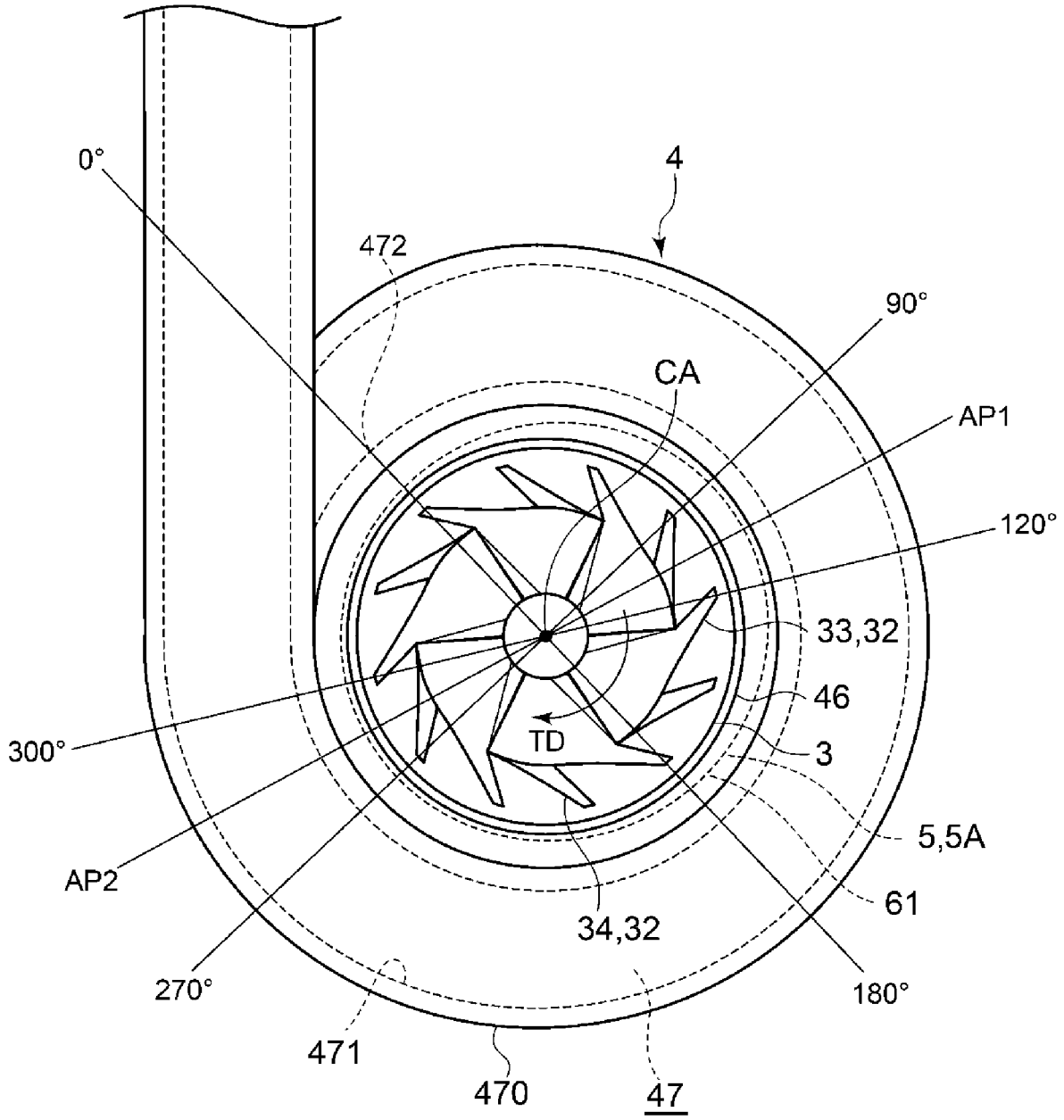
FIG. 11 is an explanatory diagram illustrating the shape of a groove portion according to an embodiment of the present disclosure, and schematically illustrates a compressor as viewed from a front side.
Figure 12:
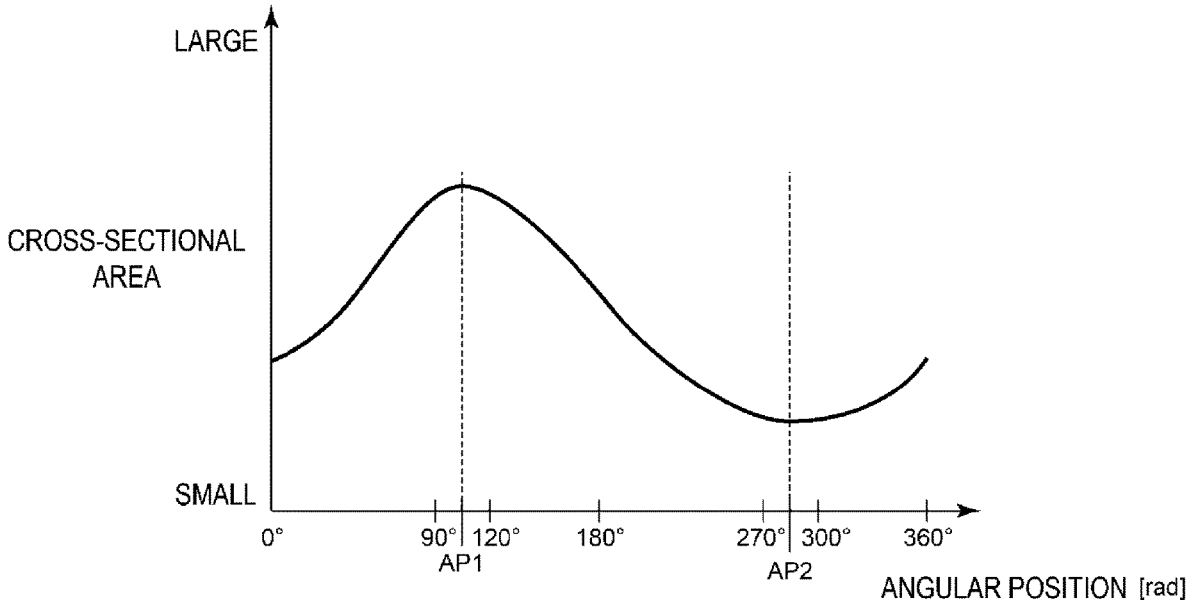
FIG. 12 is a diagram illustrating a relationship between an angular position illustrated in FIG. 11 and a cross-sectional area of the groove portion.

FIG. 11 is an explanatory diagram illustrating the shape of a groove portion according to an embodiment of the present disclosure, and schematically illustrates a compressor as viewed from the front side. FIG. 12 is a diagram illustrating the relationship between an angular position illustrated in FIG. 11 and a cross-sectional area of the groove portion.

In some embodiments, as illustrated in FIG. 11, the at least one groove portion 5 described above includes the ring-shaped groove 5A. The ring-shaped groove 5A was configured to have the largest cross-sectional area in an angular range from an angular position of 0° to an angular position of 120° in the circumferential direction, where the angular position of a tongue portion 472 of the scroll flow path-forming section 470 in the circumferential direction of the impeller 3 is defined as 0°, and a downstream direction (clockwise direction) in the rotational direction (tangential direction TD) of the impeller 3 is defined as a positive direction of the angular position in the circumferential direction. This "cross-sectional area" refers to an opening area of the ring-shaped groove 5A in a cross section taken along the axis CA of the ring-shaped groove 5A.

In the illustrated embodiment, as illustrated in FIG. 11, the cross-sectional area of the ring-shaped groove 5A in the circumferential direction is increased and decreased by increasing and decreasing the maximum depth W in the circumferential direction. As illustrated in FIGS. 11 and 12, the maximum depth W and the cross-sectional area of each ring-shaped groove 5A reach a maximum at one angular position AP1 located within an angular range from an angular position of 90° to an angular position of 120° in the circumferential direction, and reach a minimum at one angular position AP2 located within an angular range from an angular position of 270° to angular position of 300° in the circumferential direction. Each ring-shaped groove 5A is configured to have the maximum depth W and the cross-sectional area gradually decreasing in both the clockwise direction and the counterclockwise direction between the angular positions AP1 to AP2. Note that in some other embodiments, the cross-sectional area in the circumferential direction may be increased and decreased by increasing and decreasing the distance H from the upstream side end portion 52 to the downstream side end portion 51 in the circumferential direction.

The backflow F2 is not uniform in the circumferential direction, and is large at a certain portion in the circumferential direction (an angular range from an angular position of 0° to an angular position of 120° in the circumferential direction) compared with other portions. According to the above, the cross-sectional area of each ring-shaped groove 5A is not uniform in the circumferential direction, and reaches a maximum in the angular range from the angular position of 0° to the angular position of 120° in the circumferential direction. With the cross-sectional area of the ring-shaped groove 5A thus increased in the portion where the backflow F2 is large, the development of the backflow range RB in the portion can be effectively suppressed. Thus, the development of the backflow range RB in the vicinity of the shroud surface 46 can be effectively suppressed entirely over the circumferential direction.

For example, as illustrated in FIG. 3, the compressor 11 according to some embodiments includes the above-described impeller 3 including at least the hub 31 and the plurality of blades 32, and the compressor housing 4 having the above-described at least one groove portion 5 formed in the shroud surface 46. In this case, the at least one groove portion 5 formed in the shroud surface 46 of the compressor housing 4 can suppress surging under the low flow rate condition, whereby the operation range of the compressor 11 can be expanded in the low flow rate range. The above-described configuration does not hinder the pulsation of gas introduced to the impeller 3, and thus a surging suppression effect can be provided by the pulsation of the internal combustion engine 2 on the downstream side of the compressor 11.

Figure 13:
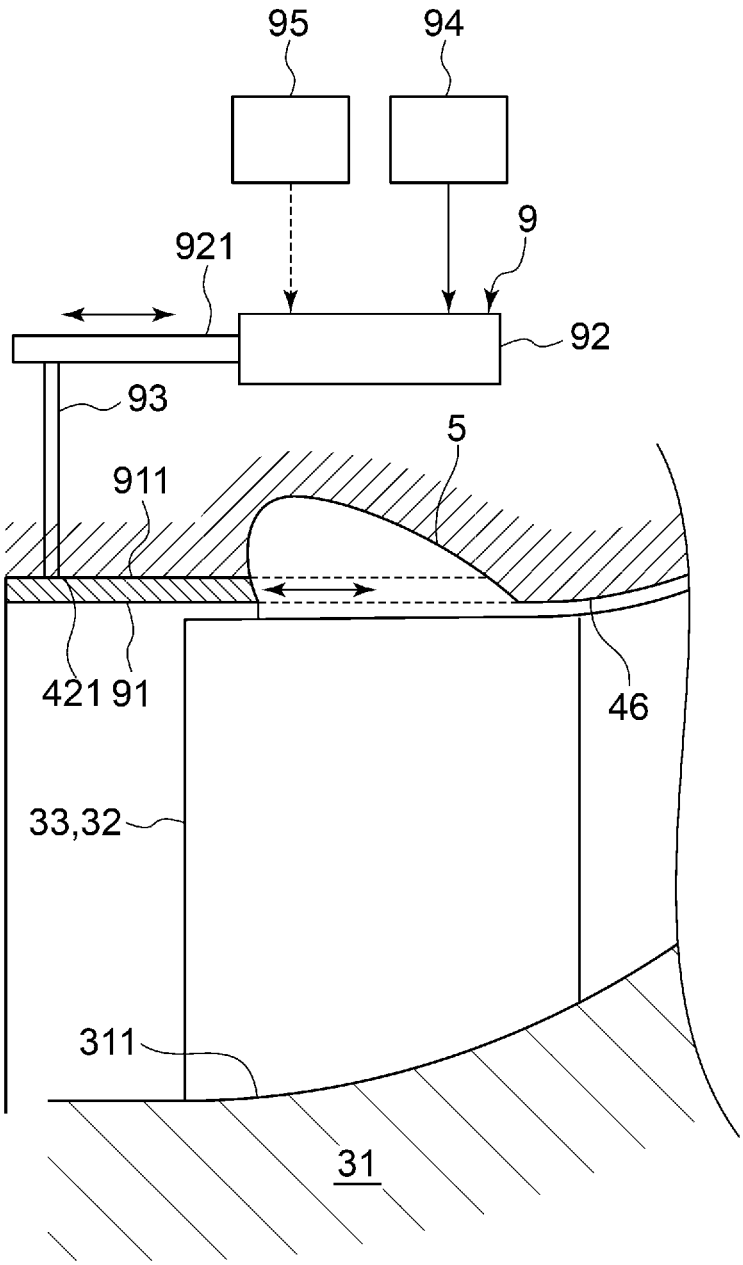
FIG. 13 is a schematic cross-sectional view schematically illustrating a compressor side of the turbocharger including the compressor according to an embodiment of the present disclosure, and is a schematic cross-sectional view including an axis of the compressor housing.

FIG. 13 is a schematic cross-sectional view schematically illustrating a compressor side of the turbocharger including the compressor according to one embodiment of the present disclosure, and is a schematic cross-sectional view including an axis of the compressor housing.

In some embodiments, as illustrated in FIG. 13, the above-described compressor 11 further includes a groove portion opening/closing device 9 including a cover 91 that covers the groove portion 5 in an openable/closable manner, and an opening/closing mechanism unit 92 configured to perform opening and closing operations for the cover 91.

In the illustrated embodiment, the cover 91 is composed of a tubular-shaped body disposed on an inner side of the inner wall surface 421 in the radial direction, and has an outer surface 911 in sliding contact with the inner wall surface 421. The opening/closing mechanism unit 92 is composed of an actuator (for example, an air cylinder) including a drive shaft 921 that is movable in forward and backward directions using air supplied from the outside. The opening/closing mechanism unit 92 is arranged such that the drive shaft 921 extends along the axial direction X. The groove portion opening/closing device 9 includes a rod-shaped connecting member 93 having a first end portion side connected to the outer surface 911 of the cover 91 and having a second end portion side connected to the drive shaft 921, an air supply source 94 used for supplying air to the opening/closing mechanism unit 92, and an opening/closing instruction device 95 configured to issue a drive instruction for the drive shaft 921 to the opening/closing mechanism unit 92 in accordance with the operating range of the compressor 11. The opening/closing mechanism unit 92 causes the drive shaft 921 to move forward and backward using air supplied from the air supply source 94. The cover 91 is moved in conjunction with the forward and backward movement of the drive shaft 921, via the connecting member 93, to open and close the groove portion 5.

The opening/closing instruction device 95 is an electronic control unit used for controlling the opening and closing operations for the cover 91 by using the opening/closing mechanism unit 92, and may be configured as a microcomputer including a CPU (processor), a memory such as a ROM and a RAM, a storage device such as an external storage device, an I/O interface, and a communication interface, which are not illustrated. The CPU may operate (for example, perform a data operation or the like) in accordance with, for example, program instructions loaded into the main storage device of the memory to control the opening and closing operations for the cover 91 by using the opening/closing mechanism unit 92. The opening/closing instruction device 95 has pre-stored information associating an operating range of the compressor 11 (for example, the operating range on a compressor map) with the opening/closing instruction to the opening/closing mechanism unit 92, and is configured to identify the operation range of the compressor 11 based on the information input from the compressor 11 and issue the opening/closing instruction corresponding to the operation range to the opening/closing mechanism unit 92. The opening/closing mechanism unit 92 drives the drive shaft 921 to open/close the cover 91 in accordance with the instruction issued from the opening/closing instruction device 95.

According to the configuration described above, the compressor 11 includes the groove portion opening/closing device 9 including the cover 91 that covers the groove portion 5 in an openable/closable manner, and the opening/closing mechanism unit 92 configured to perform opening and closing operations for the cover 91. In this case, the groove portion 5 is opened by opening the cover 91 in an operating range in which surging is likely to occur in the operating range of the compressor 11. Thus, the development of the backflow range RB in the vicinity of the shroud surface 46 can be suppressed, whereby the operation range of the compressor 11 can be expanded. In an operating range in which surging is less likely to occur in the operating range of the compressor 11, the cover 91 is closed to close the groove portion 5. Thus, the gap between the compressor housing 4 and the impeller 3 is made small, whereby efficiency reduction of the compressor 11 due to the gap can be suppressed.

In some embodiments, as illustrated in FIG. 1, the turbocharger 1 described above includes the above-described compressor 11 and the turbine 12 including the turbine rotor 14 connected to the impeller 3 of the compressor 11 via the rotation shaft 13. In this case, the at least one groove portion 5 formed in the shroud surface 46 of the compressor housing 4 can suppress the development of the backflow range and surging under the low flow rate condition, whereby the operation range of the compressor 11 can be expanded in the low flow rate range. The above-described configuration does not hinder the pulsation of gas introduced to the impeller 3, and thus a surging suppression effect can be provided by the pulsation of the internal combustion engine 2 on the downstream side of the compressor 11.

The present disclosure is not limited to the embodiments described above, and also includes a modification of the above-described embodiments as well as appropriate combinations of these modes.

The contents of some embodiments described above can be construed as follows, for example.

1) A compressor housing (4) according to at least one embodiment of the present disclosure is a compressor housing (4) configured to rotatably house an impeller (3) including a hub (31) and a plurality of blades (32) provided on an outer surface of the hub, the compressor housing (4) including:

an intake flow path-forming section (420) configured to form an intake flow path (42) through which gas is introduced to the impeller (3) from outside of the compressor housing (4);

a shroud portion (460) having a shroud surface (46) curved in a protruding manner to face the plurality of blades (32); and a scroll flow path-forming section (470) configured to form a scroll flow path (47) through which the gas that has passed through the impeller (3) is guided to the outside of the compressor housing (4), wherein at least one groove portion (5) extending in a circumferential direction is formed in the shroud surface (46), and in a cross-sectional view taken along an axis (CA) of the impeller (3), the at least one groove portion (5) includes:

a downstream side wall surface (6), a distance to which from the axis (CA) increases toward an upstream side from a downstream side end portion (51) of the at least one groove portion (5), and an upstream side curved surface (7) that is formed to be curved in a recessed manner between an upstream end (61) of the downstream side wall surface (6) and an upstream side end portion (52) of the at least one groove portion (5) and is configured to have a most upstream position (71) positioned further upstream than the upstream side end portion (52).

According to the configuration 1) described above, the at least one groove portion (5) formed in the shroud surface (46) includes the downstream side wall surface (6), the distance to which from the axis (CA) increases toward the upstream side from the downstream side end portion (51), and the upstream side curved surface (7) formed between the upstream side end portion (52) and the upstream end (61) of the downstream side wall surface (6). Under the low flow rate condition, gas introduced to the impeller is separated from the shroud surface (46) and the blades (32) of the impeller (3) due to an adverse pressure gradient, whereby the backflow (F2, flow towards the front side XF in the axial direction X) is generated in the vicinity of the shroud surface (46). This backflow is provided with tangential speed (TS, see FIG. 5) due to the rotation of the impeller (3). The centrifugal action provided by the tangential speed (TS) causes the backflow to flow along the downstream side wall surface (6) and enter the groove portion (5). The upstream side curved surface (7) is curved in a recessed manner, and has a most upstream position (71) positioned further upstream than the upstream side end portion (52). Thus, the backflow (F2) that has entered the groove portion (5) can have its flow direction turned around to flow toward the rear side (XR) from the direction toward the front side (XF) in the axial direction with the speed maintained, so as to be sent to the vicinity of the shroud surface (46). With the backflow (F2) thus turned around by the groove portion (5) to be sent toward the vicinity of the shroud surface (46), the development of the backflow range (RB) in the vicinity of the shroud surface (46) can be suppressed. Thus, surging under the low flow rate condition can be suppressed, whereby a wider range of the compressor (11) in the low flow rate range can be achieved.

The above-described configuration 1) does not hinder the pulsation of gas introduced to the impeller (3) unlike in the configuration described in WO 2011/099419 A where recirculation flow is introduced to the impeller. Thus, the surging suppression effect can be provided by the pulsation of the internal combustion engine (2) on the downstream side of the compressor (11).

2) According to some embodiments, in the compressor housing (4) according to 1) described above, the downstream side wall surface (6) includes a downstream side curved surface (6A) that is curved in a recessed manner toward an outer side in a radial direction and has a smaller curvature than the upstream side curved surface (7).

According to the configuration of 2) above, the downstream side wall surface (6) includes the downstream side curved surface (6A) that is curved in a recessed manner toward the outer side in the radial direction. Thus, compared with a case where the downstream side wall surface (6) extends linearly or is curved in a protruding manner, the distance between the downstream side wall surface (6) and the axis (CA) between the downstream side end portion (51) of the groove portion (5) and the upstream end (61) of the downstream side wall surface (6) can be increased. Thus, the backflow (F2) flowing along the downstream side wall surface (6) into the groove portion (5) and the turned-around flow (the backflow F2 that has turned around) exiting from the groove portion (5) along the upstream side curved surface (7) after being turned around by the upstream side curved surface (7) can be prevented from interfering with each other and offsetting each other. The downstream side curved surface (6A) is gently curved with a curvature (C6A) being smaller than a curvature (C7) of the upstream side curved surface (7) to facilitate the entrance of the backflow (F2) into the groove portion (5) along the downstream side curved surface (6A), whereby the flow rate of the backflow (F2) turned around by the groove portion (5) can be increased. By increasing the flow rate of the backflow (F2) that is turned around by the groove (5), the development of the backflow range (RB) in the vicinity of the shroud surface (46) can be effectively suppressed.

3) According to some embodiments, in the compressor housing (4) according to 1) or 2) described above, in the cross-sectional view taken along the axis (CA) of the impeller (3), the at least one groove portion (5) has a center (53) positioned between a leading edge (331) and a trailing edge (332) of each of the plurality of blades (32, long blades 33) in an extending direction of the axis (CA).

Between the leading edge (331) and the trailing edge (332) of the blade (32) in the extending direction of the axis (CA), entrance of the backflow (F2) flowing along the shroud surface (46) into the groove portion (5) is facilitated by the strong centrifugal action attributable to significant tangential speed (TS) due to the rotation of the impeller (3). According to the configuration 3) described above, the center (53) of the at least one groove portion (5) is positioned between the leading edge (331) and the trailing edge (332) of the blade (32) in the extending direction of the axis (CA). Thus, entrance of the backflow (F2) into the groove portion (5) is facilitated by the strong centrifugal action of the backflow (F2), whereby the flow rate of the backflow (F2) turned around by the groove portion (5) can be increased further than in a case where the groove portion (5) is provided at another position in the extending direction of the axis (CA). Thus, the development of the backflow range (RB) in the vicinity of the shroud surface (46) can be prevented effectively.

4) According to some embodiments, in the compressor housing (4) according to any one of 1) to 3) described above, the at least one groove portion (5) is configured to satisfy a condition of $5° \leq \theta 1 \leq 45°$, where θ1 represents an inclination angle of the upstream side curved surface (7) relative to a first normal (N1) passing through the upstream side end portion (52) of the shroud surface (46).

According to the configuration 4) described above, the inclination angle θ1 of the upstream side curved surface (7) of the at least one groove portion (5) satisfies the condition of $5° \leq \theta 1 \leq 45°$, so that with the backflow exiting the groove portion (5) along the upstream side curved surface (7), the development of the backflow range in the vicinity of the shroud surface (46) can be effectively suppressed. If the inclination angle θ1 is less than 5°, the speed component toward the inner side in the radial direction of the backflow that has exited the groove portion (5) along the upstream side curved surface (7) becomes excessively large, and the flow rate of the flow toward the vicinity of the shroud surface (46) becomes small. As a result, the development of the backflow range (RB) in the vicinity of the shroud surface (46) may fail to be sufficiently suppressed. If the inclination angle θ1 is greater than 45°, the speed component toward the inner side in the radial direction of the backflow (F2) that has exited the groove portion (5) along the upstream side curved surface (7) becomes excessively small, and the backflow (F2) that has exited the groove portion (5) along the upstream side curved surface (7) may interfere with the backflow (F2) entering the groove portion (5) along the downstream side wall surface (6). Thus, these flows may offset each other.

5) According to some embodiments, in the compressor housing (4) according to any one of 1) to 4) described above, the groove portion (5) is configured to satisfy a condition of $0.50 \leq W/H \leq 0.85$, where H represents a distance from the upstream side end portion (52) to the downstream side end portion (51) of the at least one groove portion (5) in the extending direction of the axis (CA), and W represents a maximum depth of the at least one groove portion (5).

According to the configuration 5) described above, the at least one groove portion (5) satisfies the condition of $0.50 \leq W/H \leq 0.85$, so that with the backflow (F2) exiting the groove portion (5) along the upstream side curved surface (7), the development of the backflow range (RB) in the vicinity of the shroud surface (46) can be effectively suppressed. If the ratio W/H of the maximum depth W to the distance H is less than 0.5, the maximum depth W becomes too small, and the backflow (F2) that has exited the groove portion (5) along the upstream side curved surface (7) may interfere with the backflow (F2) entering the groove portion (5) along the downstream side wall surface (6). Thus, these flows may offset each other. If the ratio W/H of the maximum depth W to the distance H exceeds 0.85, the maximum depth W becomes too large, and the backflow (F2) that has entered the groove portion (5) may be difficult to flow along the downstream side wall surface (6) or the upstream side curved surface (7). Thus, the turned-around flow may fail to be formed.

6) According to some embodiments, in the compressor housing (4) according to any one of 1) to 5) described above, the at least one groove portion (5) is configured to satisfy a condition of $0.10 \leq H/R \leq 0.30$, where H represents a distance from the upstream side end portion (52) to the downstream side end portion (51) of the at least one groove portion (5) in the extending direction of the axis (CA), and R represents a distance from the axis (CA) to the upstream side end portion (52) in a direction orthogonal to the axis (CA).

According to the configuration 6) described above, the condition of $0.10 \leq H/R \leq 0.30$ is satisfied, so that an appropriate ratio between the flow rate of the main flow (F1) of the gas flowing into the impeller (3) and the flow rate of the backflow (F2) flowing into the groove (5) can be achieved. With the ratio set to be appropriate, the entrance of the backflow (F2) in the groove portion (5) is facilitated, whereby the development of the backflow range (RB) in the vicinity of the shroud surface (46) can be suppressed.

7) According to some embodiments, in the compressor housing according to any one of 1) to 6) described above, the at least one groove portion (5) includes a ring-shaped groove (5A) extending over entire circumference in the circumferential direction.

According to the configuration 7) described above, the ring-shaped groove (5A) extends entirely over the circumferential direction, so that the backflow (F2) can be turned around by the ring-shaped groove (5A) anywhere in the entire circumferential direction. Thus, the development of the backflow range (RB) in the vicinity of the shroud surface (46) can be prevented entirely over the circumferential direction.

8) According to some embodiments, in the compressor housing (4) according to 7) described above, the ring-shaped groove (5A) is configured to have a maximum cross-sectional area in an angular range from an angular position of 0° to an angular position of 120° in the circumferential direction, where an angular position of a tongue portion (472) of the scroll flow path-forming section (470) in the circumferential direction of the impeller (3) is defined as 0° and a downstream direction in a rotational direction of the impeller (3) is defined as a positive direction of an angular position in the circumferential direction.

The backflow (F2) is not uniform in the circumferential direction, and is large in a certain portion in the circumferential direction (an angular range from an angular position of 0° to an angular position of 120° in the circumferential direction) compared with other portions. According to the configuration 8) described above, the cross-sectional area of the ring-shaped groove (5A) is not uniform in the circumferential direction, and becomes the largest in the angular range from the angular position of 0° to the angular position of 120° in the circumferential direction. With the cross-sectional area of the ring-shaped groove (5A) thus increased in the portion where the backflow (F2) is large, the development of the backflow range (RB) in the portion can be effectively suppressed. Thus, the development of the backflow range (RB) in the vicinity of the shroud surface (46) can be effectively suppressed entirely over the circumferential direction.

9) In some embodiments, in the compressor housing (4) according to any one of 1) to 6) described above, the at least one groove portion (5) includes a plurality of inclined grooves (5B) that extend partially over the entire circumference in the circumferential direction, in a direction inclined with respect to the circumferential direction, and are formed at intervals along the circumferential direction.

According to the configuration 9) described above, the plurality of inclined grooves (5B) are formed at intervals along the circumferential direction of the shroud surface (46). Thus, the backflow (F2) can be turned around by the plurality of inclined grooves (5B) partially over the entire circumference in the circumferential direction. Thus, the development of the backflow range (RB) in the vicinity of the shroud surface (46) can be prevented partially over the entire circumference in the circumferential direction.

10) According to some embodiments, in the compressor housing (4) according to 9) described above, each of the plurality of inclined grooves (5B) is configured to have an end portion (54) on a trailing edge side positioned further downstream than an end portion (55) on a leading edge side in the rotational direction (tangential direction TD) of the impeller (3).

According to the configuration 10) described above, each of the plurality of inclined grooves (5B) has the end portion (54) on the trailing edge side positioned more on the downstream side than the end portion (55) on the leading edge side in the rotational direction of the impeller (3). With the inclined grooves (5B) thus extending in the direction along the flow direction of the backflow (F2), entrance of the backflow (F2) into the inclined groove (5B) is facilitated, whereby the flow rate of the backflow (F2) that is turned around by the inclined grooves (5B) can be increased. Thus, the development of the backflow range (RB) in the vicinity of the shroud surface (46) can be prevented effectively.

11) According to some embodiments, in the compressor housing (4) according to 10) described above, in a cross-sectional view along an extending direction of the plurality of inclined grooves (5B), each of the plurality of inclined grooves (5B) includes:

a trailing edge side wall surface (6B), a distance to which from the axis (CA) of the impeller (3) increases from the end portion (54) on the trailing edge side toward the end portion (55) on the leading edge side of each inclined groove (5B), and a leading edge side curved surface (7B) curved in a recessed manner between a leading edge (61B) of the trailing edge side wall surface (6B) and the end portion (55) on the leading edge side, and configured to have a most upstream position (71B) positioned more on the leading edge side than the end portion (55) on the leading edge side.

According to the configuration 11) described above, each of the plurality of inclined grooves (5B) includes the trailing edge side wall surface (6B) in a cross-sectional view taken along the extending direction of the inclined groove (5B), that is, the direction along the flow direction of the backflow (F2). In this case, the entrance of the backflow (F2) into the inclined groove (5B) along the trailing edge side wall surface (6B) is facilitated, whereby the flow rate of the backflow (F2) turned around by the inclined groove (5B) can be increased. Each of the plurality of inclined grooves (5B) includes the trailing edge side wall surface (6B) and the leading edge side curved surface (7B) in the cross-sectional view described above. In this case, the backflow (F2) that has entered the inclined groove (5B) flows along the trailing edge side wall surface (6B) and the leading edge side curved surface (7B), and thus can be sent to the vicinity of the shroud surface (46) after having the flow direction turned around while maintaining the speed. According to the configuration described above, the development of the backflow range (RB) in the vicinity of the shroud surface (46) can be prevented effectively.

12) A compressor (11) according to at least one embodiment of the present disclosure includes:

an impeller (3) including at least a hub (31) and a plurality of blades (32) provided to an outer surface (311) of the hub (31); and the compressor housing (4) described in any one of 1) to 11) described above.

According to the configuration 12) described above, the at least one groove (5) formed in the shroud surface (46) of the compressor housing (4) can suppress the surging under the low flow rate condition, whereby the operation range of the compressor (11) can be expanded in the low flow rate range. The above-described configuration does not hinder the pulsation of gas introduced to the impeller (3), whereby the surging suppression effect can be provided by the pulsation of the internal combustion engine (2) on the downstream side of the compressor (11).

13) According to some embodiments, the compressor (11) according to 12) described above further includes a groove portion opening/closing device (9) including a cover (91) that covers a groove portion (5) in an openable/closable manner, and an opening/closing mechanism unit (92) configured to perform opening and closing operations for the cover (91).

According to the configuration 13) described above, the compressor (11) includes a groove portion opening/closing device (9) including a cover (91) that covers the groove (5) so as to be opened and closed, and an opening/closing mechanism unit (92) configured to perform the opening and closing operations for the cover (91). In this case, the groove portion (5) is opened by opening the cover (91) in the operating range with a high risk of occurrence of the surging, in the operating range of the compressor (11). Thus, the development of the backflow range (RB) in the vicinity of the shroud surface (46) can be suppressed, whereby the operation range of the compressor (11) can be expanded. In the operating range with a low risk of occurrence of the surging, in the operating range of the compressor (11), the cover (91) is closed to close the groove portion (5). Thus, the gap between the compressor housing (4) and the impeller (3) is made small, whereby the efficiency reduction of the compressor (11) due to the gap can be suppressed.

14) A turbocharger (1) according to at least one embodiment of the present disclosure includes:

the compressor (11) described in 12) or 13); and a turbine (12) including a turbine rotor (14) connected to the impeller (3) of the compressor (11) via a rotational shaft (13).

According to the configuration 14) described above, the at least one groove (5) formed in the shroud surface (46) of the compressor housing (4) can suppress the development of the backflow range and the surging under the low flow rate condition, whereby the operation range of the compressor (11) can be expanded in the low flow rate range. The above-described configuration does not hinder the pulsation of gas introduced to the impeller (3), whereby the surging suppression effect can be provided by the pulsation of the internal combustion engine (2) on the downstream side of the compressor (11).

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A compressor comprising:

an impeller including a hub and a plurality of blades on an outer surface of the hub; and a compressor housing configured to rotatably house the impeller, wherein the compressor housing comprises:

an intake flow path-forming section configured to form an intake flow path through which gas is introduced to the impeller from outside of the compressor housing;

a shroud portion including a shroud surface curved in a protruding manner to face the plurality of blades such that a gap is between the shroud portion and a tip side edge of each of the plurality of blades; and a scroll flow path-forming section configured to form a scroll flow path through which the gas that has passed through the impeller is guided to the outside of the compressor housing, wherein at least one groove portion extending in a circumferential direction is defined in the shroud surface, wherein, in a cross-sectional view taken along an axis of the impeller, the at least one groove portion includes:

a downstream side wall surface, wherein a distance from the axis of the impeller to the downstream side wall surface increases toward an upstream side from a downstream side end portion of the at least one groove portion; and an upstream side curved surface that is recessed between an upstream end of the downstream side wall surface and an upstream side end portion of the at least one groove portion, and configured to have a furthest upstream position which is further upstream than the upstream side end portion of the at least one groove portion, wherein the plurality of blades includes a plurality of full blades and a plurality of splitter blades, each of the plurality of splitter blades having a shorter extending length than each of the plurality of full blades, wherein, in the cross-sectional view taken along the axis of the impeller, the at least one groove portion is configured to satisfy a condition of $0.2 \leq Z/L \leq 1.2$, where L represents a distance from a hub end of a trailing edge of each of the plurality of full blades to a tip end of a leading edge of each of the plurality of full blades in an extending direction of the axis of the impeller, and Z represents a distance from the hub end of the trailing edge of each of the plurality of full blades to the upstream side end portion of the at least one groove portion in the extending direction of the axis of the impeller, and wherein a leading edge of each of the plurality of splitter blades is downstream of the at least one groove portion.

2. The compressor according to claim 1, wherein the downstream side wall surface includes a downstream side curved surface that is recessed toward an outer side in a radial direction and has a smaller curvature than the upstream side curved surface.

3. The compressor according to claim 1, wherein, in the cross-sectional view taken along the axis of the impeller, the at least one groove portion has a center of gravity positioned between the leading edge of each of the plurality of full blades and the trailing edge of each of the plurality of full blades in the extending direction of the axis of the impeller.

4. The compressor according to claim 1, wherein the at least one groove portion is configured to satisfy a condition of $5° \leq \theta 1 \leq 45°$, where $\theta 1$ represents an inclination angle of the upstream side curved surface relative to a normal passing through the upstream side end portion of the at least one groove portion.

5. The compressor according to claim 1, wherein the at least one groove portion is configured to satisfy a condition of $0.50 \leq W/H \leq 0.85$, where H represents a distance from the upstream side end portion of the at least one groove portion to the downstream side end portion of the at least one groove portion in the extending direction of the axis of the impeller, and W represents a maximum depth of the at least one groove portion.

6. The compressor according to claim 1, wherein the at least one groove portion is configured to satisfy a condition of $0.10 \leq H/R \leq 0.30$, where H represents a distance from the upstream side end portion of the at least one groove portion to the downstream side end portion of the at least one groove portion in the extending direction of the axis of the impeller, and R represents a distance from the axis of the impeller to the upstream side end portion of the at least one groove portion in a direction orthogonal to the axis of the impeller.

7. The compressor according to claim 1, wherein the at least one groove portion includes a ring-shaped groove extending over an entire circumference in the circumferential direction.

8. The compressor according to claim 7, wherein the ring-shaped groove is configured to have a maximum cross-sectional area in an angular range from an angular position of 0° to an angular position of 120° in the circumferential direction, such that an angular position of a tongue portion of the scroll flow path-forming section in the circumferential direction is defined as 0° and a downstream direction in a rotational direction of the impeller is defined as a positive direction of an angular position in the circumferential direction.

9. The compressor according to claim 1, wherein the at least one groove portion includes a plurality of inclined grooves defined at intervals along the circumferential direction and extending partially over an entire circumference in the circumferential direction, in a direction inclined with respect to the circumferential direction.

10. The compressor according to claim 9, wherein each of the plurality of inclined grooves is configured to have an end portion on a trailing edge side positioned further downstream than an end portion on a leading edge side in a rotational direction of the impeller.

11. The compressor according to claim 10, wherein, in a cross-sectional view along an extending direction of the plurality of inclined grooves, each of the plurality of inclined grooves includes:

a trailing edge side wall surface, wherein a distance from the axis of the impeller to the trailing edge side wall surface increases from the end portion on the trailing edge side toward the end portion on the leading edge side; and a leading edge side curved surface recessed between a leading edge of the trailing edge side wall surface and the end portion on the leading edge side and configured to have a furthest upstream position which is further on the leading edge side than the end portion on the leading edge side.

12. The compressor according to claim 1, further comprising:

a groove portion opening/closing device including a cover configured to openably/closably cover the at least one groove portion, and an opening/closing mechanism unit configured to perform an opening operation for the cover and a closing operation for the cover.

13. A turbocharger comprising:

the compress according to claim 1; and a turbine including a turbine rotor connected to the impeller via a rotational shaft.

* * * * *